US012072133B2

(12) United States Patent
Lee et al.

(10) Patent No.: US 12,072,133 B2
(45) Date of Patent: Aug. 27, 2024

(54) REFRIGERATOR AND CONTROL METHOD THEREFOR

(71) Applicant: LG ELECTRONICS INC., Seoul (KR)

(72) Inventors: Donghoon Lee, Seoul (KR); Wookyong Lee, Seoul (KR); Seungseob Yeom, Seoul (KR); Donghoon Lee, Seoul (KR); Yongjun Bae, Seoul (KR); Sunggyun Son, Seoul (KR); Chongyoung Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 507 days.

(21) Appl. No.: 17/282,640

(22) PCT Filed: Oct. 1, 2019

(86) PCT No.: PCT/KR2019/012879
§ 371 (c)(1),
(2) Date: Apr. 2, 2021

(87) PCT Pub. No.: WO2020/071766
PCT Pub. Date: Apr. 9, 2020

(65) Prior Publication Data

US 2021/0348821 A1 Nov. 11, 2021

(30) Foreign Application Priority Data

Oct. 2, 2018 (KR) ..... 10-2018-0117785
Oct. 2, 2018 (KR) ..... 10-2018-0117819
(Continued)

(51) Int. Cl.
*F25C 1/18* (2006.01)
*F25C 1/24* (2018.01)
*F25C 5/08* (2006.01)

(52) U.S. Cl.
CPC ..... *F25C 1/18* (2013.01); *F25C 1/24* (2013.01); *F25C 5/08* (2013.01); *F25C 2400/10* (2013.01);
(Continued)

(58) Field of Classification Search
CPC ..... F25C 1/18; F25C 1/24; F25C 5/08; F25C 2400/10; F25C 2400/14; F25C 2600/04; F25C 2700/14; F25C 2700/02
See application file for complete search history.

(56) References Cited

U.S. PATENT DOCUMENTS 3,686,890 A 8/1972 Lyman
5,187,948 A 2/1993 Frohbieter
(Continued)

FOREIGN PATENT DOCUMENTS

CN 1963346 5/2007
CN 102878743 1/2013
(Continued)

OTHER PUBLICATIONS

English Language translation of KR 2011/0058091 to Lee. Translated Nov. 2023 (Year: 2011).*
(Continued)

*Primary Examiner* — Cassey D Bauer
(74) *Attorney, Agent, or Firm* — KED & ASSOCIATES, LLP

(57) ABSTRACT

The refrigerator of the present invention comprises: a storage compartment where food is stored; a cold air supply means for supplying cold air to the storage compartment; a first tray forming a part of an ice making cell which is a space where water phase-changes into ice by the cold air; a second tray which forms another part of the ice making cell and which can be brought into contact with the first tray during an ice making process, and which is connected to a
(Continued)

driving unit so as to be spaced apart from the first tray during an ice separating process; a heater positioned adjacent to at least one of the first tray and the second tray; an ice bin for storing ice dropped from the ice making cell; a full ice level sensing means for sensing a full ice level of the ice bin; and a control unit for controlling the heater and the driving unit. When the full ice level of the ice bin is sensed by the full ice level sensing means, the control unit controls the driving unit such that the second tray moves to the ice separating position after the ice making is completed.

13 Claims, 16 Drawing Sheets

(30) Foreign Application Priority Data

| | | |
|---|---|---|
| Oct. 2, 2018 | (KR) | 10-2018-0117821 |
| Oct. 2, 2018 | (KR) | 10-2018-0117822 |
| Nov. 16, 2018 | (KR) | 10-2018-0142117 |
| Jul. 6, 2019 | (KR) | 10-2019-0081712 |
| Jul. 6, 2019 | (KR) | 10-2019-0081742 |

(52) U.S. Cl.
CPC ..... *F25C 2400/14* (2013.01); *F25C 2600/04* (2013.01); *F25C 2700/14* (2013.01)

(56) References Cited

U.S. PATENT DOCUMENTS

| | | | | |
|---|---|---|---|---|
| 9,335,081 | B2 * | 5/2016 | Son | F25C 1/04 |
| 2010/0218525 | A1 * | 9/2010 | Woo | G01F 23/2921 62/344 |
| 2013/0081412 | A1 | 4/2013 | Son et al. | |
| 2013/0327082 | A1 * | 12/2013 | Son | F25C 1/24 62/344 |
| 2014/0038060 | A1 | 2/2014 | Abe | |
| 2014/0182325 | A1 | 7/2014 | Lee et al. | |
| 2018/0187941 | A1 | 7/2018 | An et al. | |
| 2018/0231294 | A1 | 8/2018 | Song et al. | |
| 2019/0078824 | A1 * | 3/2019 | Yun | F25C 1/10 |

FOREIGN PATENT DOCUMENTS

| | | |
|---|---|---|
| CN | 103033011 | 4/2013 |
| EP | 0326144 | 8/1989 |
| EP | 2578969 | 4/2013 |
| EP | 3059526 | 8/2016 |
| GB | 191020801 | 6/1911 |
| JP | H05-203299 | 8/1993 |
| JP | H05-203302 | 8/1993 |
| JP | H06-147708 | 5/1994 |
| JP | H06-070543 | 9/1994 |
| JP | H06-70543 | 9/1994 |
| JP | H09-269172 | 10/1997 |
| JP | 2005-326035 | 11/2005 |
| JP | 4572833 | 11/2010 |
| JP | 2011-064371 | 3/2011 |
| JP | 2011-064373 | 3/2011 |
| JP | 2011-237077 | 11/2011 |
| JP | 2013-032878 | 2/2013 |
| JP | 6070543 | 2/2017 |
| KR | 10-2005-0069319 | 7/2005 |
| KR | 10-2005-0096336 | 10/2005 |
| KR | 10-0756994 | 9/2007 |
| KR | 10-2007-0119271 | 12/2007 |
| KR | 10-2009-0079377 | 7/2009 |
| KR | 10-0935746 | 1/2010 |
| KR | 10-2011-0098091 | 9/2011 |
| KR | 10-2012-0003233 | 1/2012 |
| KR | 10-2013-0009332 | 1/2013 |
| KR | 10-2013-0009521 | 1/2013 |
| KR | 10-2014-0088321 | 7/2014 |
| KR | 10-1635222 | 6/2016 |
| KR | 10-2016-0088665 | 7/2016 |
| KR | 10-1643635 | 7/2016 |
| KR | 10-1850918 | 5/2018 |
| KR | 10-2018-0100752 | 9/2018 |

OTHER PUBLICATIONS

Korean Office Action dated Jul. 4, 2023 issued in Application No. 10-2018-0142117.
International Search Report (with English Translation) and Written Opinion (with English Translation) dated Jan. 28, 2020 issued in Application No. PCT/KR2019/012879.
Extended European Search Report dated Jun. 8, 2022 issued in Application No. 19869274.1.
Chinese Office Action dated Jun. 10, 2022 issued in Application No. 201980063994.2.
Korean Office Action dated May 1, 2023 issued in Application No. 10-2018-0117785.
Korean Office Action dated May 8, 2023 issued in Application No. 10-2018-0117819.
Korean Office Action dated May 14, 2023 issued in Application No. 10-2018-0117821.
Korean Office Action dated May 15, 2023 issued in Application No. 10-2018-0117822.
Korean Notice of Allowance dated Nov. 7, 2023 issued in Application No. 10-2018-0117821.
Korean Notice of Allowance dated Jan. 10, 2024 issued in Application No. 10-2018-0142117.
Korean Office Action dated Feb. 22, 2024 issued in Application No. 10-2018-0117785.
Korean Office Action dated Mar. 12, 2024 issued in Application No. 10-2018-0117822.
Korean Office Action dated May 7, 2024 issued in Application No. 10-2019-0081712.
Korean Office Action dated Jun. 19, 2024 issued in Application No. 10-2018-0117819.

* cited by examiner

REFRIGERATOR AND CONTROL METHOD THEREFOR

CROSS-REFERENCE TO RELATED PATENT APPLICATIONS

This application is a U.S. National Stage Application under 35 U.S.C. § 371 of PCT Application No. PCT/KR2019/012879, filed Oct. 1, 2019, which claims priority to Korean Patent Application Nos. 10-2018-0117819, filed Oct. 2, 2018, 10-2018-0117821, filed Oct. 2, 2018, 10-2018-0117822, filed Oct. 2, 2018, 10-2018-0117785, filed Oct. 2, 2018, 10-2018-0142117, filed Nov. 16, 2018, 10-2019-0081742, filed Jul. 6, 2019, and 10-2019-0081712, filed Jul. 6, 2019, whose entire disclosures are hereby incorporated by reference.

TECHNICAL FIELD

The present disclosure relates to a refrigerator and a control method therefor.

BACKGROUND ART

In general, refrigerators are home appliances for storing food at a low temperature in a storage space that is covered by a door. The refrigerator may cool the inside of the storage space by using cold air to store the stored food in a refrigerated or frozen state. Generally, an ice maker for making ice is provided in the refrigerator. The ice maker makes ice by cooling water after accommodating the water supplied from a water supply source or a water tank into a tray. The ice maker separates the made ice from the ice tray in a heating manner or twisting manner.

The ice maker through which water is automatically supplied, and the ice automatically separated may be, for example, opened upward so that the mode ice is pumped up.

As described above, the ice made in the ice maker may have at least one flat surface such as crescent or cubic shape.

When the ice has a spherical shape, it is more convenient to use the ice, and also, it is possible to provide different feeling of use to a user. Also, even when the made ice is stored, a contact area between the ice cubes may be minimized to minimize a mat of the ice cubes.

An ice maker is disclosed in Korean Registration No. 10-1850918 (hereinafter, referred to as a "prior art document 1") that is a prior art document.

The ice maker disclosed in the prior art document 1 includes an upper tray in which a plurality of upper cells, each of which has a hemispherical shape, are arranged, and which includes a pair of link guide parts extending upward from both side ends thereof, a lower tray in which a plurality of upper cells, each of which has a hemispherical shape and which is rotatably connected to the upper tray, a rotation shaft connected to rear ends of the lower tray and the upper tray to allow the lower tray to rotate with respect to the upper tray, a pair of links having one end connected to the lower tray and the other end connected to the link guide part, and an upper ejecting pin assembly connected to each of the pair of links in at state in which both ends thereof are inserted into the link guide part and elevated together with the upper ejecting pin assembly.

In the prior art document 1, although the spherical ice is made by the hemispherical upper cell and the hemispherical lower cell, since the ice is made at the same time in the upper and lower cells, bubbles containing water are not completely discharged but are dispersed in the water to make opaque ice.

An ice maker is disclosed in Japanese Patent Laid-Open No. 9-269172 (hereinafter, referred to as a "prior art document 2") that is a prior art document.

The ice maker disclosed in the prior art document 2 includes an ice making plate and a heater for heating a lower portion of water supplied to the ice making plate.

In the case of the ice maker disclosed in the prior art document 2, water on one surface and a bottom surface of an ice making block is heated by the heater in an ice making process. Thus, when solidification proceeds on the surface of the water, and also, convection occurs in the water to make transparent ice.

When growth of the transparent ice proceeds to reduce a volume of the water within the ice making block, the solidification rate is gradually increased, and thus, sufficient convection suitable for the solidification rate may not occur.

Thus, in the case of the prior art document 2, when about ⅔ of water is solidified, a heating amount of heater increases to suppress an increase in the solidification rate.

However, according to the prior art document 2, when only the volume of water is reduced, the heating amount of heater may increase, and thus, it may be difficult to make ice having uniform transparency according to shapes of ice.

DISCLOSURE

Technical Problem

Embodiments provide a refrigerator which is capable of making ice having uniform transparency as a whole regardless of shapes of the ice and a method for manufacturing the same.

Embodiments also provide a refrigerator which is capable of making spherical ice and has uniform transparency of the spherical ice for unit height and a method for manufacturing the same.

Embodiments also provide a refrigerator in which a heating amount of transparent ice heater and/or cooling power of the cooler vary in response to the change in heat transfer amount between water in an ice making cell and cold air in a storage chamber, thereby making ice having uniform transparency as a whole and a method for manufacturing the same.

Embodiments also provide a refrigerator in which since ice stands by after being separated even if full ice of an ice bin is detected to solve a problem in which ice inside an ice making cell is melted and then re-frozen due an abnormal state in the atmosphere to deteriorate transparency of the ice, and a method for manufacturing the same.

Technical Solution

A refrigerator according to one aspect may include a first tray and a second tray forming an ice making cell. A heater may be disposed at one side of the first tray or the second tray.

The heater may be turned on in at least partial section while a cold air supply part supplies cold air to the ice making cell so that bubbles dissolved in the water within the ice making cell moves from a portion, at which the ice is made, toward the water that is in a liquid state to make transparent ice.

The first tray may form a portion of the ice making cell, which is a space in which water is phase-changed into ice by the cold air, and the second tray may form another portion of the ice making cell. In the ice making process, the second tray may be in contact with the first tray, and in the ice separation process, the second tray may be spaced apart from the first tray. The second tray may be connected to the driver to receive power from the driver.

The second tray may move from the water supply position to the ice making position by the operation of the driver. Also, the second tray may move from the ice making position to the ice making position by the operation of the driver. The water supply of the ice making cell may be performed while the second tray moves to the water supply position.

After the water supply is completed, the second tray may move to the ice making position. After the second tray moves to the ice making position, the cold air supply part may supply cold air to the ice making cell.

When the ice making in the ice making cell is completed, the second tray may move to the ice separation position in a forward direction to take out the ice of the ice making cell. After the second tray moves to the iced position, the second tray may move to the water supply position in a reverse direction, and water supply may be started again.

The refrigerator according to this embodiment may further include a full ice detection part.

When the full ice of the ice bin is detected by the full ice detection part, the second tray may move to the ice separation position after the ice making is completed.

The full ice detection part may detect the full ice while the second tray moves from the ice making position to the ice separation position. After the second tray moves to the ice separation position, the full ice detection part may repetitively perform the full ice detection at a predetermined period. After the second tray moves to the ice separation position, the second tray may move to the water supply position to stand by.

When a set time elapses after the second tray moves to the water supply position, whether ice is fully refilled may be detected by the full ice detection part. In the result of whether the ice is fully refilled, when the ice full is detected, the second tray may stand by at the water supply position. On the other hand, when the ice full is not detected, the water supply may start in the state in which the second tray is disposed at the water supply position.

The full ice detection part may include a full ice detection lever that rotates by receiving power of the driver. An extension line of a rotation center of the full ice detection lever may be parallel to an extension line of a rotation center of the second tray.

The full ice detection lever may include a first body extending in a direction parallel to the extension line of the rotation center of the second tray and a pair of second bodies respectively extending from both ends of the first body. One of the pair of second bodies may be connected to the driver. While the full ice detection lever rotates, the first body may be disposed lower than the second tray. The full ice detection lever may rotate to a full ice detection position, and at the full ice detection position, the first body may be inserted into the ice bin. A maximum distance between an upper end of the ice bin and the first body may be less than a radius of ice generated in the ice making cell.

In this embodiment, one or more of cooling power of the cold air supply part, a heating amount of the heater may be controlled to vary according to a mass per unit height of water within the ice making cell.

As one example, a heating amount of heater may be controlled so that the heating amount of heater when a mass per unit height of water is large is less than that of heater when a mass per unit height of the water is small while maintaining the same cooling power of the cold air supply part. As another example, the cooling power of the cold air supply part may be controlled so that the cooling power of the cold air supply part when the mass per unit height of the water is large is greater than that of the cold air supply part when the mass per unit height of the water is small while the heating amount of heater is uniformly maintained.

When a heat transfer amount between the cold air within the storage chamber and the water of the ice making cell increases, the heating amount of heater increases, and when the heat transfer amount between the cold air within the storage chamber and the water of the ice making cell decreases, the heating amount of heater decreases so as to maintain an ice making rate of the water within the ice making cell within a predetermined range that is less than an ice making rate when the ice making is performed in a state in which the heater is turned off.

When a total volume of ice separated into the ice bin reaches a set full ice reference value, the ice bin may be determined as a full ice state.

The total volume of the separated ice may correspond a volume of the ice making cell×the number of times of separation of the ice. The full ice reference value may be greater than 60% of a total volume of the ice bin, and may a value obtained by subtracting the volume of the ice making cell from the total volume of the ice bin may be set.

A method for controlling a refrigerator according to another aspect relates to a method for controlling a refrigerator including a first tray accommodated in a storage chamber, a second tray forming an ice making cell together with the first tray, a driver moving the second tray, and a heater supplying heat to one or more of the first tray and the second tray.

The method for controlling the refrigerator includes: supplying water to the ice making cell in a state in which the second tray moves to a water supply position; performing ice making after the second tray moves to an ice making position in a reverse direction at the water supply position when the water is completely supplied; determining whether an ice bin, in which ice is stored, is full after the ice making is completed; and moving the second tray from an ice making position to an ice separation position in a forward direction regardless of the full ice of the ice bin.

The heater may be turned on in at least partial section in the performing of the ice making so that bubbles dissolved in the water within the ice making cell moves from a portion, at which the ice is made, toward the water that is in a liquid state to make transparent ice.

The method may further include, in the determining of whether the ice bin is full, when the full ice of the ice bin is detected, moving the second tray to the water supply position to stand by after the second tray moves to the ice separation position.

The method may further include, after the second tray moves to the ice separation position, redetermining whether the ice bin is full.

The method may further include, according to the result of the redetermining of whether the ice bin is full, if the ice full of the ice bin is not detected, starting the water supply.

The method may further include, according to the result of the redetermining of whether the ice bin is full, if the ice full of the ice bin is detected, moving the second tray to the water supply position to stand by.

Advantageous Effects

According to the embodiments, since the heater is turned on in at least a portion of the sections while the cold air supply part supplies cold air, the ice making rate may be delayed by the heat of the heater so that the bubbles dissolved in the water inside the ice making cell move toward the liquid water from the portion at which the ice is made, thereby making the transparent ice.

Particularly, according to the embodiments, one or more of the cooling power of the cold air supply part and the heating amount of heater may be controlled to vary according to the mass per unit height of water in the ice making cell to make the ice having the uniform transparency as a whole regardless of the shape of the ice making cell.

Also, the heating amount of transparent ice heater and/or the cooling power of the cold air supply part may vary in response to the change in the heat transfer amount between the water in the ice making cell and the cold air in the storage chamber, thereby making the ice having the uniform transparency as a whole.

MODE FOR INVENTION

Figure 1:
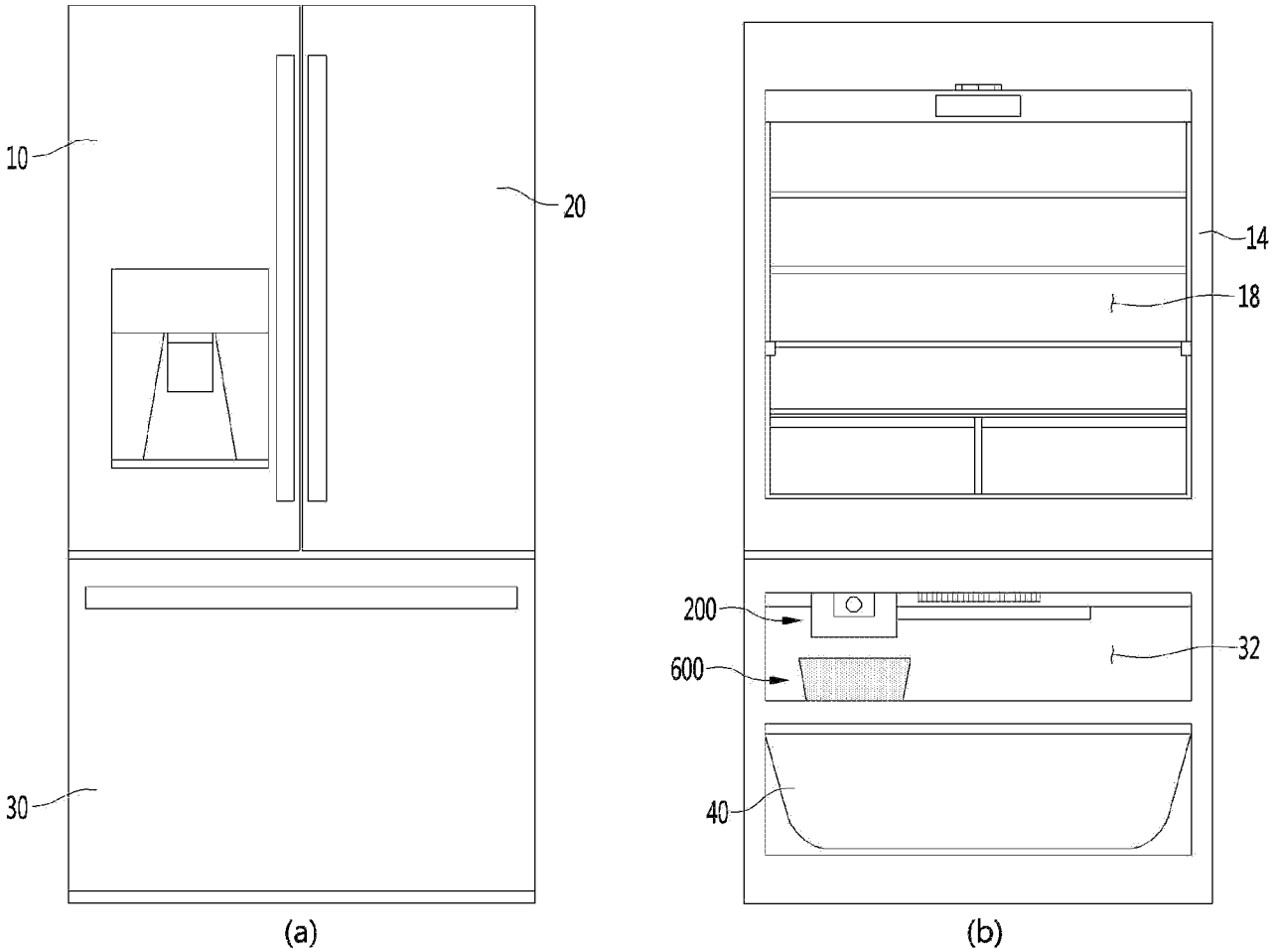
FIG. 1 is a front view of a refrigerator according to an embodiment of the present invention.

Hereinafter, some embodiments of the present invention will be described in detail with reference to the accompanying drawings. Exemplary embodiments of the present invention will be described below in more detail with reference to the accompanying drawings. It is noted that the same or similar components in the drawings are designated by the same reference numerals as far as possible even if they are shown in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

FIG. 1 is a front view of a refrigerator according to an embodiment.

Referring to FIG. 1, a refrigerator according to an embodiment may include a cabinet 14 including a storage chamber and a door that opens and closes the storage chamber.

The storage chamber may include a refrigerating compartment 18 and a freezing compartment 32. The refrigerating compartment 18 is disposed at an upper side, and the freezing compartment 32 is disposed at a lower side. Each of the storage chamber may be opened and closed individually by each door. For another example, the freezing compartment may be disposed at the upper side and the refrigerating compartment may be disposed at the lower side. Alternatively, the freezing compartment may be disposed at one side of left and right sides, and the refrigerating compartment may be disposed at the other side.

The freezing compartment 32 may be divided into an upper space and a lower space, and a drawer 40 capable of being withdrawn from and inserted into the lower space may be provided in the lower space.

The door may include a plurality of doors 10, 20, 30 for opening and closing the refrigerating compartment 18 and the freezing compartment 32. The plurality of doors 10, 20, and 30 may include some or all of the doors 10 and 20 for opening and closing the storage chamber in a rotatable manner and the door 30 for opening and closing the storage chamber in a sliding manner. The freezing compartment 32 may be provided to be separated into two spaces even though the freezing compartment 32 is opened and closed by one door 30.

In this embodiment, the freezing compartment 32 may be referred to as a first storage chamber, and the refrigerating compartment 18 may be referred to as a second storage chamber.

The freezing compartment 32 may be provided with an ice maker 200 capable of making ice. The ice maker 200 may be disposed, for example, in an upper space of the freezing compartment 32.

An ice bin 600 in which the ice made by the ice maker 200 drops to be stored may be disposed below the ice maker 200. A user may take out the ice bin 600 from the freezing compartment 32 to use the ice stored in the ice bin 600.

The ice bin 600 may be mounted on an upper side of a horizontal wall that partitions an upper space and a lower space of the freezing compartment 32 from each other. Although not shown, the cabinet 14 is provided with a duct supplying cold air to the ice maker 200. The duct guides the cold air heat-exchanged with a refrigerant flowing through the evaporator to the ice maker 200. For example, the duct may be disposed behind the cabinet 14 to discharge the cold air toward a front side of the cabinet 14. The ice maker 200 may be disposed at a front side of the duct.

Although not limited, a discharge hole of the duct may be provided in one or more of a rear wall and an upper wall of the freezing compartment 32. Although the above-described ice maker 200 is provided in the freezing compartment 32, a space in which the ice maker 200 is disposed is not limited to the freezing compartment 32. For example, the ice maker 200 may be disposed in various spaces as long as the ice maker 200 receives the cold air.

Figure 2:
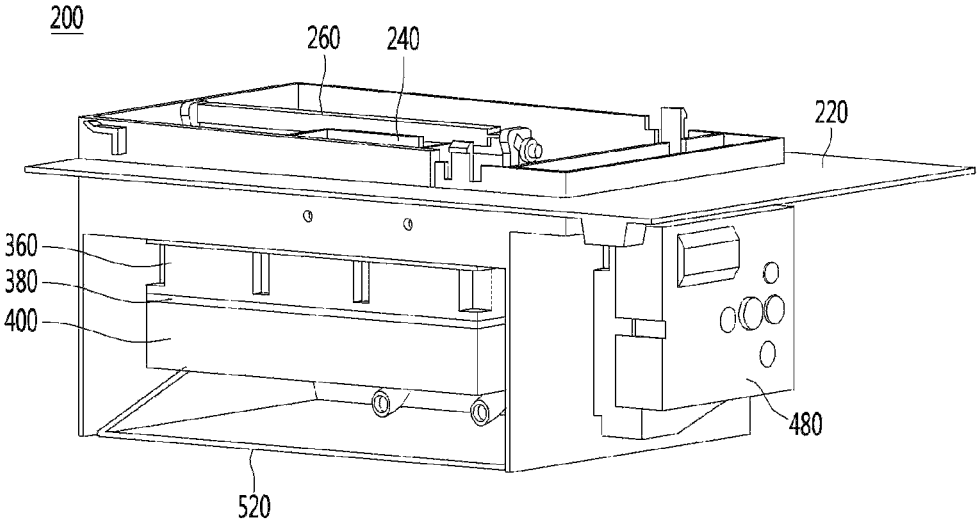
FIG. 2 is a perspective view of an ice maker according to an embodiment of the present invention.
Figure 3:
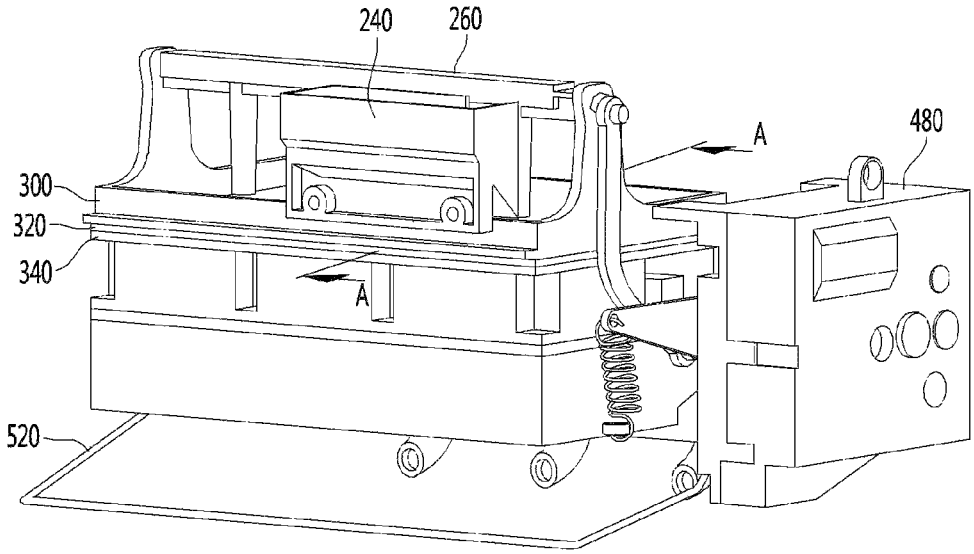
FIG. 3 is a perspective view illustrating a state in which a bracket is removed from the ice maker of FIG. 2.
Figure 4:
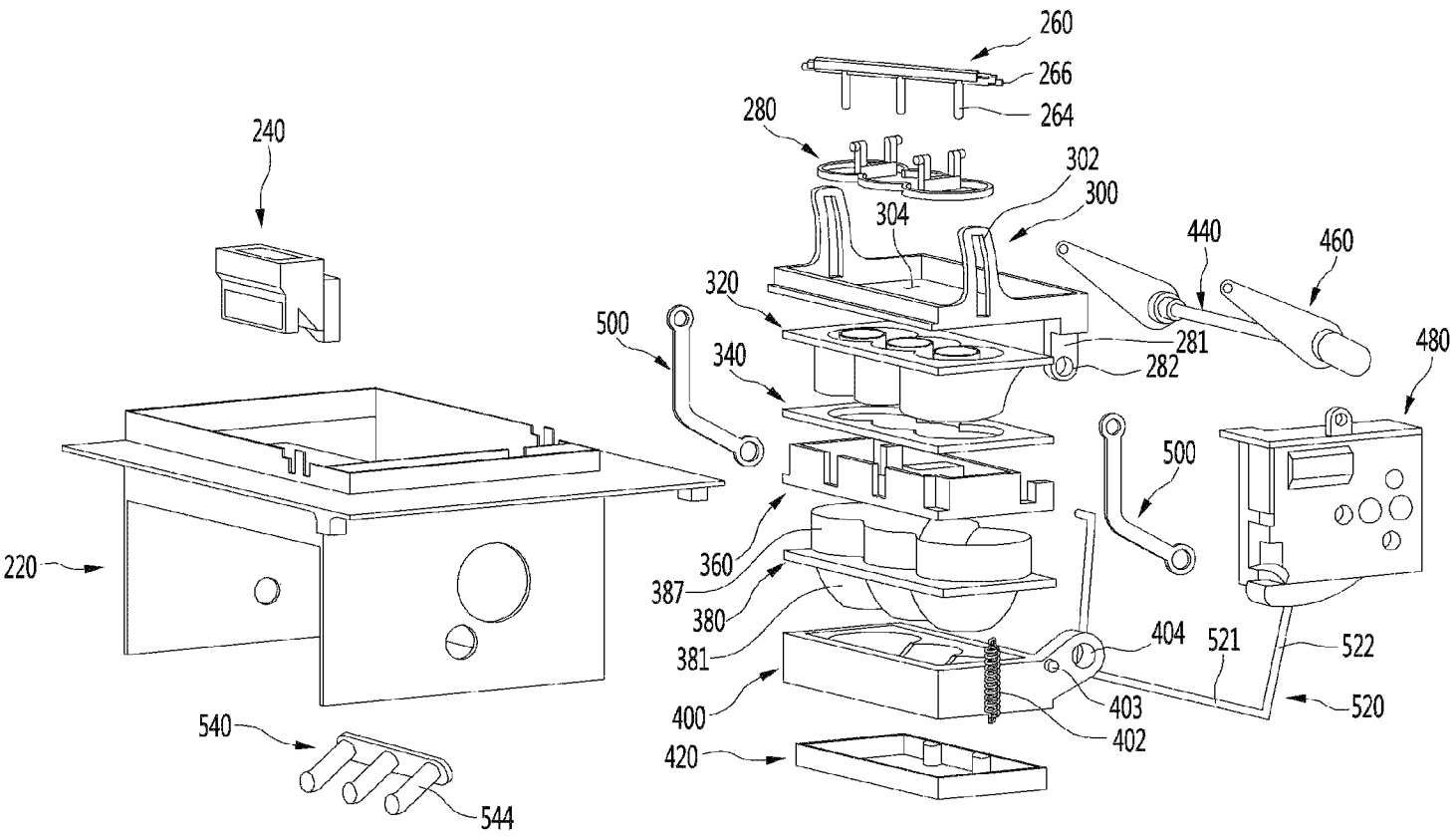
FIG. 4 is an exploded perspective view of the ice maker according to an embodiment of the present invention.
Figure 5:
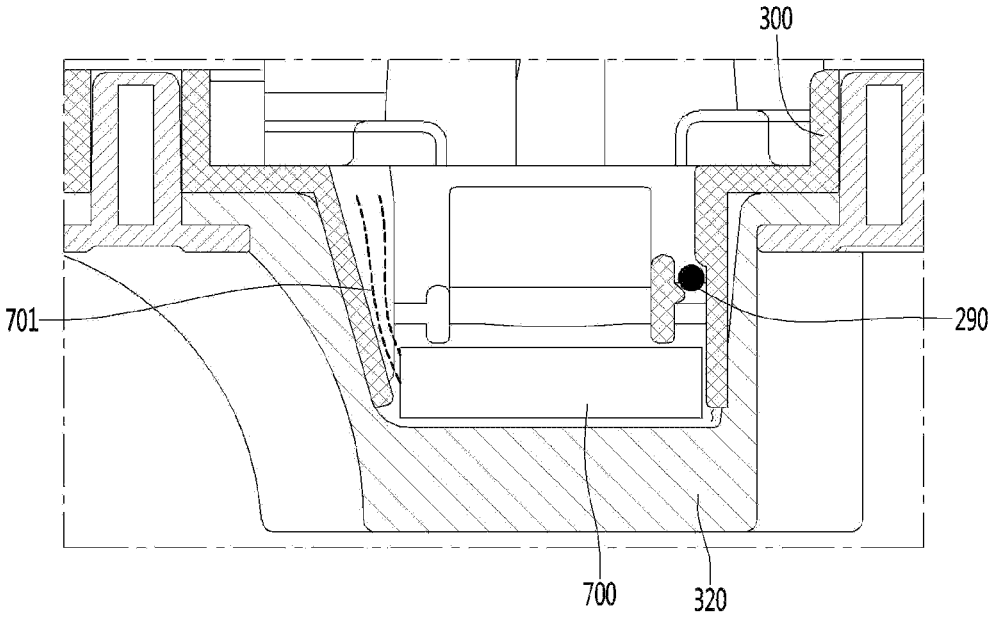
FIG. 5 is a cross-sectional view taken along line A-A of FIG. 3 so as to show a second temperature sensor installed in the ice maker according to an embodiment of the present invention.

FIG. 2 is a perspective view of the ice maker according to an embodiment, FIG. 3 is a perspective view illustrating a state in which the bracket is removed from the ice maker of FIG. 2, and FIG. 4 is an exploded perspective view of the ice maker according to an embodiment. FIG. 5 is a cross-sectional view taken along line A-A of FIG. 3 so as to show a second temperature sensor installed in the ice maker according to an embodiment.

Figure 6:
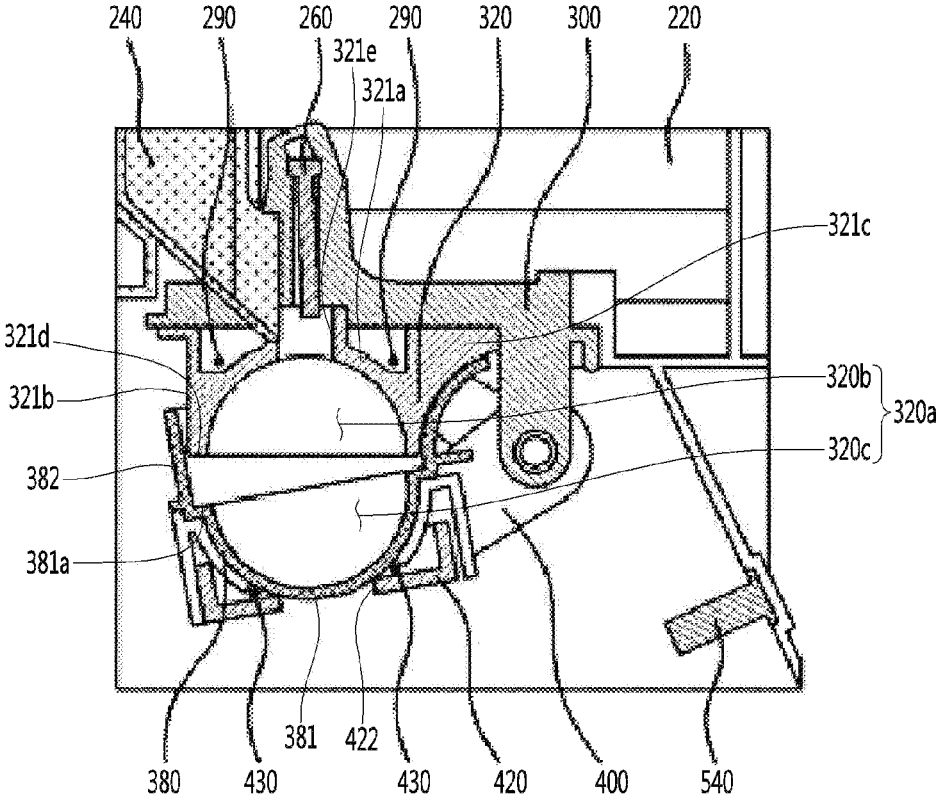
FIG. 6 is a longitudinal cross-sectional view of the ice maker when a second tray is disposed at a water supply position according to an embodiment of the present invention.

FIG. 6 is a longitudinal cross-sectional view of the ice maker when a second tray is disposed at a water supply position according to an embodiment.

Referring to FIGS. 2 to 6, each component of the ice maker 200 may be provided inside or outside the bracket 220, and thus, the ice maker 200 may constitute one assembly.

The bracket 220 may be installed at, for example, the upper wall of the freezing compartment 32. The water supply part 240 may be installed on an upper side of an inner surface of the bracket 220. The water supply part 240 may be provided with an opening in each of an upper side and a lower side to guide water, which is supplied to an upper side of the water supply part 240, to a lower side of the water supply part 240. The upper opening of the water supply part 240 may be greater than the lower opening to limit a discharge range of water guided downward through the water supply part 240. A water supply pipe through which water is supplied may be installed to the upper side of the water supply part 240. The water supplied to the water supply part 240 may move downward. The water supply part 240 may prevent the water discharged from the water supply pipe from dropping from a high position, thereby preventing the water from splashing. Since the water supply part 240 is disposed below the water supply pipe, the water may be guided downward without splashing up to the water supply part 240, and an amount of splashing water may be reduced even if the water moves downward due to the lowered height.

The ice maker 200 may include an ice making cell 320*a* in which water is phase-changed into ice by the cold air.

The ice maker 200 may include a first tray 320 defining at least a portion of a wall providing the ice making cell 320*a* and a second tray 380 defining at least the other portion of a wall providing the ice making cell 320*a*. Although not limited, the ice making cell 320*a* may include a first cell 320*b* and a second cell 320*c*.

The first tray 320 may define the first cell 320*b*, and the second tray 380 may define the second cell 320*c*.

The second tray 380 may be disposed to be relatively movable with respect to the first tray 320. The second tray 380 may linearly rotate or rotate. Hereinafter, the rotation of the second tray 380 will be described as an example.

For example, in an ice making process, the second tray 380 may move with respect to the first tray 320 so that the first tray 320 and the second tray 380 contact each other. When the first tray 320 and the second tray 380 are in contact with each other, the complete ice making cell see 320*a* may be defined.

On the other hand, the second tray 380 may move with respect to the first tray 320 during the ice making process after the ice making is completed, and the second tray 380 may be spaced apart from the first tray 320.

In this embodiment, the first tray 320 and the second tray 380 may be arranged in a vertical direction in a state in which the ice making cell 320*a* is defined. Accordingly, the first tray 320 may be referred to as an upper tray, and the second tray 380 may be referred to as a lower tray.

A plurality of ice making cells 320*a* may be defined by the first tray 320 and the second tray 380. In FIG. 4, for example, three ice making cells 320*a* are provided.

When water is cooled by cold air while water is supplied to the ice making cell 320*a*, ice having the same or similar shape as that of the ice making cell 320*a* may be made.

In this embodiment, for example, the ice making cell 320*a* may be provided in a spherical shape or a shape similar to a spherical shape. In this case, the first cell 320*b* may be provided in a hemisphere shape or a shape similar to the hemisphere. Also, the second cell 320*c* may be provided in a hemisphere shape or a shape similar to the hemisphere. The ice making cell 320*a* may have a rectangular parallelepiped shape or a polygonal shape.

The ice maker 200 may further include a first tray case 300 coupled to the first tray 320. For example, the first tray case 300 may be coupled to an upper side of the first tray 320. The first tray case 300 may be manufactured as a separate part from the bracket 220 and then may be coupled to the bracket 220 or integrally formed with the bracket 220.

The ice maker 200 may further include a first heater case 280. An ice separation heater 290 may be installed in the second heater case 280. The heater case 280 may be integrally formed with the first tray case 300 or may be separately formed.

The ice separation heater 290 may be disposed at a position adjacent to the first tray 320. For example, the ice separation heater 290 may be a wire-type heater. For example, the ice separation heater 290 may be installed to contact the second tray 320 or may be disposed at a position spaced a predetermined distance from the second tray 320. In some cases, the ice separation heater 290 may supply heat to the first tray 320, and the heat supplied to the first tray 320 may be transferred to the ice making cell 320*a*.

The ice maker 200 may further include a first tray cover 340 disposed below the first tray 320.

The first tray cover 340 may be provided with an opening corresponding to a shape of the ice making cell 320*a* of the first tray 320 and may be coupled to a bottom surface of the first tray 320.

The first tray case 300 may be provided with a guide slot 302 which is inclined at an upper side and vertically extended at a lower side thereof. The guide slot 302 may be provided in a member extending upward from the first tray case 300. A guide protrusion 262 of the first pusher 260 to be described later may be inserted into the guide slot 302. Thus, the guide protrusion 262 may be guided along the guide slot 302.

The first pusher 260 may include at least one extension part 264. For example, the first pusher 260 may include an extension part 264 provided with the same number as the number of ice making cells 320*a*, but is not limited thereto.

The extension part 264 may push out the ice disposed in the ice making cell 320*a* during the ice separation process. Accordingly, the extension part 264 may be inserted into the ice making cell 320*a* through the first tray case 300. Therefore, the first tray case 300 may be provided with a hole 304 through which a portion of the first pusher 260 passes.

The guide protrusion 262 of the first pusher 260 may be coupled to the pusher link 500. In this case, the guide protrusion 262 may be coupled to the pusher link 500 so as to be rotatable. Therefore, when the pusher link 500 moves, the first pusher 260 may also move along the guide slot 302.

The ice maker 200 may further include a second tray case 400 coupled to the second tray 380. The second tray case 400 may be disposed at a lower side of the second tray to support the second tray 380. For example, at least a portion of the wall defining a second cell 320*c* of the second tray 380 may be supported by the second tray case 400.

A spring 402 may be connected to one side of the second tray case 400. The spring 402 may provide elastic force to the second tray case 400 to maintain a state in which the second tray 380 contacts the first tray 320.

The ice maker 200 may further include a second tray case 360.

The second tray 380 may include a circumferential wall 382 surrounding a portion of the first tray 320 in a state of contacting the first tray 320. The second tray cover 360 may cover the circumferential wall 382.

The ice maker 200 may further include a second heater case 420. A transparent ice heater 430 may be installed in the second heater case 420.

The transparent ice heater 430 will be described in detail.

The controller 800 according to this embodiment may control the transparent ice heater 430 so that heat is supplied to the ice making cell 320*a* in at least partial section while cold air is supplied to the ice making cell 320*a* to make the transparent ice.

An ice making rate may be delayed so that bubbles dissolved in water within the ice making cell 320*a* may move from a portion at which ice is made toward liquid water by the heat of the transparent ice heater 430, thereby making transparent ice in the ice maker 200. That is, the bubbles dissolved in water may be induced to escape to the outside of the ice making cell 320*a* or to be collected into a predetermined position in the ice making cell 320*a*.

When a cold air supply part 900 to be described later supplies cold air to the ice making cell 320*a*, if the ice making rate is high, the bubbles dissolved in the water inside the ice making cell 320*a* may be frozen without moving from the portion at which the ice is made to the liquid water, and thus, transparency of the ice may be reduced.

On the contrary, when the cold air supply part 900 supplies the cold air to the ice making cell 320*a*, if the ice making rate is low, the above limitation may be solved to increase in transparency of the ice. However, there is a limitation in which an ice making time increases.

Accordingly, the transparent ice heater 430 may be disposed at one side of the ice making cell 320*a* so that the heater locally supplies heat to the ice making cell 320*a*, thereby increasing in transparency of the made ice while reducing the ice making time.

When the transparent ice heater 430 is disposed on one side of the ice making cell 320*a*, the transparent ice heater 430 may be made of a material having thermal conductivity less than that of the metal to prevent heat of the transparent ice heater 430 from being easily transferred to the other side of the ice making cell 320*a*.

At least one of the first tray 320 and the second tray 380 may be made of a resin including plastic so that the ice attached to the trays 320 and 380 is separated in the ice making process.

At least one of the first tray 320 or the second tray 380 may be made of a flexible or soft material so that the tray deformed by the pushers 260 and 540 is easily restored to its original shape in the ice separation process.

The transparent ice heater 430 may be disposed at a position adjacent to the second tray 380. For example, the transparent ice heater 430 may be a wire-type heater. For example, the transparent ice heater 430 may be installed to contact the second tray 380 or may be disposed at a position spaced a predetermined distance from the second tray 380. For another example, the second heater case 420 may not be separately provided, but the transparent heater 430 may be installed on the second tray case 400. In some cases, the transparent ice heater 430 may supply heat to the second tray 380, and the heat supplied to the second tray 380 may be transferred to the ice making cell 320*a*.

The ice maker 200 may further include a driver 480 that provides driving force. The second tray 380 may relatively move with respect to the first tray 320 by receiving the driving force of the driver 480.

A through-hole 282 may be defined in an extension part 281 extending downward in one side of the first tray case 300. A through-hole 404 may be defined in the extension part 403 extending in one side of the second tray case 400. The ice maker 200 may further include a shaft 440 that passes through the through-holes 282 and 404 together.

A rotation arm 460 may be provided at each of both ends of the shaft 440. The shaft 440 may rotate by receiving rotational force from the driver 480.

One end of the rotation arm 460 may be connected to one end of the spring 402, and thus, a position of the rotation arm 460 may move to an initial value by restoring force when the spring 402 is tensioned.

A full ice detection lever 520 may be connected to the driver 480. The full ice detection lever 520 may also rotate by the rotational force provided by the driver 480.

The full ice detection lever 520 may be a swing type lever.

The full ice detection lever 520 crosses the inside of the ice bin 600 in a rotation process.

The full ice detection lever 520 may have a '⊏' shape as a whole. For example, the full ice detection lever 520 may include a first portion 521 and a pair of second portions 522 extending in a direction crossing the first portion 521 at both ends of the first portion 521. An extension direction of the first portion 521 may be parallel to an extension direction of a rotation center of the second tray 380. Alternatively, an extension direction of the rotation center of the full ice detection lever 520 may be parallel to the extension direction of the rotation center of the second tray 380. One of the pair of second portions 522 may be coupled to the driver 480, and the other may be coupled to the bracket 220 or the first tray case 300. The full ice detection lever 520 may rotate to detect ice stored in the ice bin 600.

The ice maker 200 may further include a second pusher 540. The second pusher 540 may be installed on the bracket 220. The second pusher 540 may include at least one extension part 544. For example, the second pusher 540 may include an extension part 544 provided with the same number as the number of ice making cells 320*a*, but is not limited thereto. The extension part 544 may push the ice disposed in the ice making cell 320*a*. For example, the extension part 544 may pass through the second tray case 400 to contact the second tray 380 defining the ice making cell and then press the contacting second tray 380. Therefore, the second tray case 400 may be provided with a hole 422 through which a portion of the second pusher 540 passes.

The first tray case 300 may be rotatably coupled to the second tray case 400 with respect to the second tray supporter 400 and then be disposed to change in angle about the shaft 440.

In this embodiment, the second tray 380 may be made of a non-metal material. For example, when the second tray 380 is pressed by the second pusher 540, the second tray 380 may be made of a soft material which is deformable. Although not limited, the second tray 380 may be made of a silicon material.

Therefore, while the second tray 380 is deformed while the second tray 380 is pressed by the second pusher 540, pressing force of the second pusher 540 may be transmitted to ice. The ice and the second tray 380 may be separated from each other by the pressing force of the second pusher 540.

When the second tray 380 is made of the non-metal material and the flexible or soft material, the coupling force or attaching force between the ice and the second tray 380 may be reduced, and thus, the ice may be easily separated from the second tray 380.

Also, if the second tray 380 is made of the non-metallic material and the flexible or soft material, after the shape of the second tray 380 is deformed by the second pusher 540, when the pressing force of the second pusher 540 is removed, the second tray 380 may be easily restored to its original shape.

The first tray 320 may be made of a metal material. In this case, since the coupling force or the attaching force between the first tray 320 and the ice is strong, the ice maker 200 according to this embodiment may include at least one of the ice separation heater 290 or the first pusher 260.

For another example, the first tray 320 may be made of a non-metallic material. When the first tray 320 is made of the non-metallic material, the ice maker 200 may include only one of the ice separation heater 290 and the first pusher 260.

Alternatively, the ice maker 200 may not include the ice separation heater 290 and the first pusher 260.

Although not limited, the first tray 320 may be made of a silicon material. That is, the first tray 320 and the second tray 380 may be made of the same material. When the first tray 320 and the second tray 380 are made of the same material, the first tray 320 and the second tray 380 may have different hardness to maintain sealing performance at the contact portion between the first tray 320 and the second tray 380.

In this embodiment, since the second tray 380 is pressed by the second pusher 540 to be deformed, the second tray 380 may have hardness less than that of the first tray 320 to facilitate the deformation of the second tray 380.

Referring to FIG. 5, the ice maker 200 may further include a second temperature sensor 700 (or tray temperature sensor) for detecting a temperature of the ice making cell 320*a*. The second temperature sensor 700 may sense a temperature of water or ice of the ice making cell 320*a*.

The second temperature sensor 700 may be disposed adjacent to the first tray 320 to sense the temperature of the first tray 320, thereby indirectly determining the water temperature or the ice temperature of the ice making cell 320*a*. In this embodiment, the water temperature or the ice temperature of the ice making cell 320*a* may be referred to as an internal temperature of the ice making cell 320*a*. The second temperature sensor 700 may be installed in the first tray case 300.

In this case, the second temperature sensor 700 may contact the first tray 320 or may be spaced a predetermined distance from the first tray 320. Alternatively, the second temperature sensor 700 may be installed in the first tray 320 to contact the first tray 320.

Alternatively, when the second temperature sensor 700 may be disposed to pass through the first tray 320, the temperature of the water or the temperature of the ice of the ice making cell 320*a* may be directly detected.

A portion of the ice separation heater 290 may be disposed higher than the second temperature sensor 700 and may be spaced apart from the second temperature sensor 700. The wire 701 connected to the second temperature sensor 700 may be guided to an upper side of the first tray case 300.

Referring to FIG. 6, the ice maker 200 according to this embodiment may be designed so that a position of the second tray 380 is different from the water supply position and the ice making position.

For example, the second tray 380 may include a second cell wall 381 defining a second cell 320*c* of the ice making cell 320*a* and a circumferential wall 382 extending along an outer edge of the second cell wall 381.

The second cell wall 381 may include a top surface 381*a*. The top surface 381*a* of the second cell wall 381 may be referred to as a top surface 381*a* of the second tray 380.

The top surface 381*a* of the second cell wall 381 may be disposed lower than an upper end of the circumferential wall 381.

The first tray 320 may include a first cell wall 321*a* defining a first cell 320*b* of the ice making cell 320*a*. The first cell wall 321*a* may include a straight portion 321*b* and a curved portion 321*c*. The curved portion 321*c* may have an arc shape having a radius of curvature at the center of the shaft 440. Accordingly, the circumferential wall 381 may also include a straight portion and a curved portion corresponding to the straight portion 321*b* and the curved portion 321*c*.

The first cell wall 321*a* may include a bottom surface 321*d*. The bottom surface 321*b* of the first cell wall 321*a* may be referred to herein as a bottom surface 321*b* of the first tray 320. The bottom surface 321*d* of the first cell wall 321*a* may contact the top surface 381*a* of the second cell wall 381*a*.

For example, at the water supply position as illustrated in FIG. 6, at least portions of the bottom surface 321*d* of the first cell wall 321*a* and the top surface 381*a* of the second cell wall 381 may be spaced apart from each other. FIG. 6 illustrates that the entirety of the bottom surface 321*d* of the first cell wall 321*a* and the top surface 381*a* of the second cell wall 381 are spaced apart from each other. Accordingly, the top surface 381*a* of the second cell wall 381 may be inclined to form a predetermined angle with respect to the bottom surface 321*d* of the first cell wall 321*a*.

Although not limited, the bottom surface 321*d* of the first cell wall 321*a* may be substantially horizontal at the water supply position, and the top surface 381*a* of the second cell wall 381 may be disposed below the first cell wall 321*a* to be inclined with respect to the bottom surface 321*d* of the first cell wall 321*a*.

In the state of FIG. 6, the circumferential wall 382 may surround the first cell wall 321*a*. Also, an upper end of the circumferential wall 382 may be positioned higher than the bottom surface 321*d* of the first cell wall 321*a*.

At the ice making position (see FIG. 12), the top surface 381*a* of the second cell wall 381 may contact at least a portion of the bottom surface 321*d* of the first cell wall 321*a*.

The angle formed between the top surface 381*a* of the second tray 380 and the bottom surface 321*d* of the first tray 320 at the ice making position is less than that between the top surface 382*a* of the second tray and the bottom surface 321*d* of the first tray at the water supply position.

At the ice making position, the top surface 381*a* of the second cell wall 381 may contact all of the bottom surface 321*d* of the first cell wall 321*a*. At the ice making position, the top surface 381*a* of the second cell wall 381 and the bottom surface 321*d* of the first cell wall 321*a* may be disposed to be substantially parallel to each other.

In this embodiment, the water supply position of the second tray 380 and the ice making position are different from each other. This is done for uniformly distributing the water to the plurality of ice making cells 320*a* without providing a water passage for the first tray 320 and/or the second tray 380 when the ice maker 200 includes the plurality of ice making cells 320*a*.

If the ice maker 200 includes the plurality of ice making cells 320*a*, when the water passage is provided in the first tray 320 and/or the second tray 380, the water supplied into the ice maker 200 may be distributed to the plurality of ice making cells 320*a* along the water passage.

However, when the water is distributed to the plurality of ice making cells 320*a*, the water also exists in the water passage, and when ice is made in this state, the ice made in the ice making cells 320*a* may be connected by the ice made in the water passage portion.

In this case, there is a possibility that the ice sticks to each other even after the completion of the ice, and even if the ice is separated from each other, some of the plurality of ice includes ice made in a portion of the water passage. Thus, the ice may have a shape different from that of the ice making cell.

However, like this embodiment, when the second tray 380 is spaced apart from the first tray 320 at the water supply position, water dropping to the second tray 380 may be uniformly distributed to the plurality of second cells 320*c* of the second tray 380.

For example, the first tray 320 may include a communication hole 321*e*. When the first tray 320 includes one first cell 320*b*, the first tray 320 may include one communication hole 321*e*. When the first tray 320 includes a plurality of first cells 320*b*, the first tray 320 may include a plurality of communication holes 321*e*. The water supply part 240 may supply water to one communication hole 321*e* of the plurality of communication holes 321*e*. In this case, the water supplied through the one communication hole 321*e* drops to the second tray 380 after passing through the first tray 320.

In the water supply process, water may drop into any one of the second cells 320*c* of the plurality of second cells 320*c* of the second tray 380. The water supplied to one of the second cells 320*c* may overflow from the one of the second cells 320*c*.

In this embodiment, since the top surface 381*a* of the second tray 380 is spaced apart from the bottom surface 321*d* of the first tray 320, the water overflowed from any one of the second cells 320*c* may move to the adjacent other second ell 320*c* along the top surface 381*a* of the second tray 380. Therefore, the plurality of second cells 320*c* of the second tray 380 may be filled with water.

Also, in the state in which water supply is completed, a portion of the water supplied may be filled in the second cell 320*c*, and the other portion of the water supplied may be filled in the space between the first tray 320 and the second tray 380.

Figure 12:
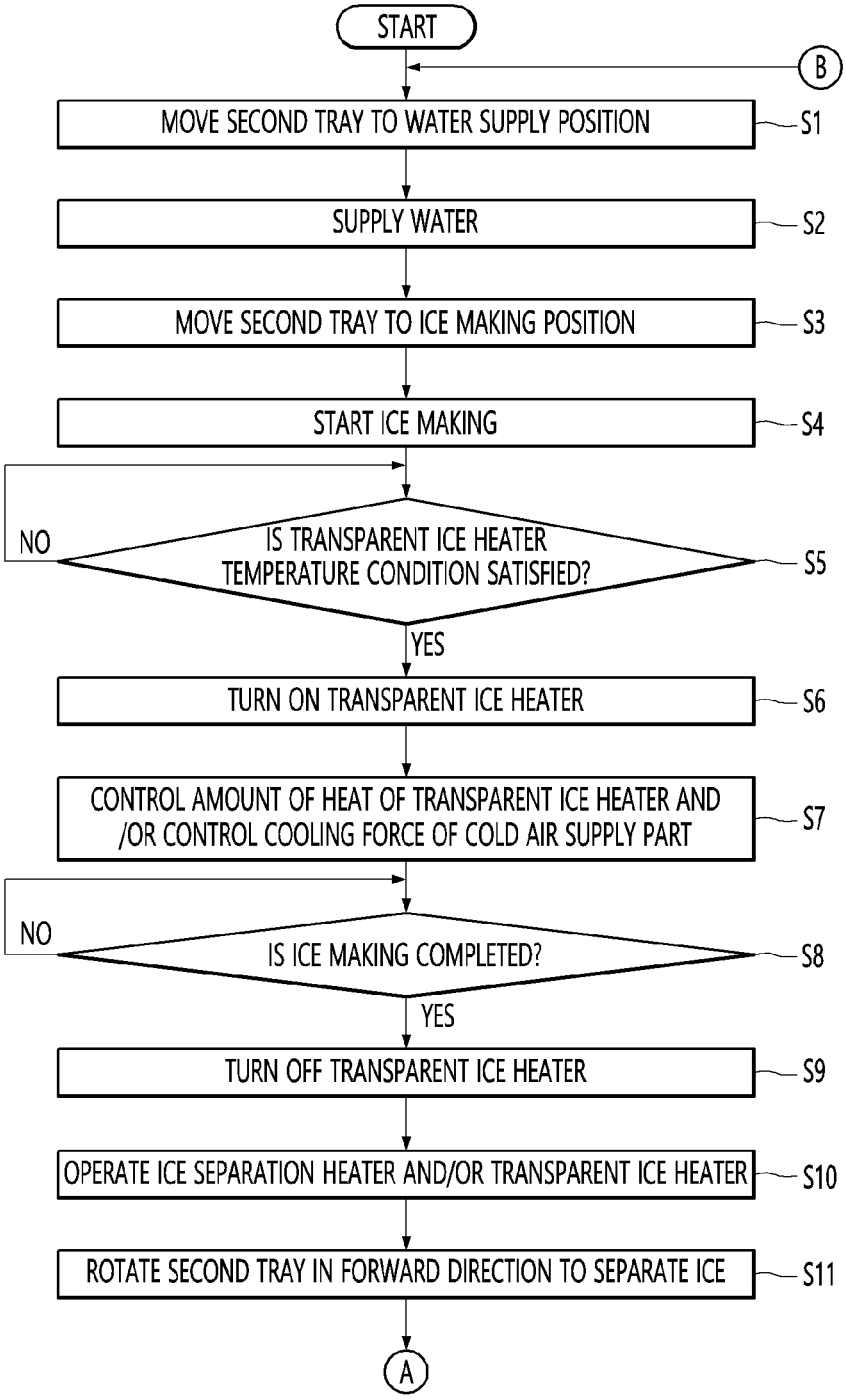
FIGS. 12 and 13 are flowcharts for explaining a process of making ice in the ice maker according to an embodiment of the present invention.

At the water supply position, according to a volume of the ice making cell 320*a*, the water when the water supply is completed may be disposed only in the space between the first tray 320 and the second tray 380 or may also be disposed in the space between the second tray 380 and the first tray 320 (see FIG. 12).

When the second tray 380 move from the water supply position to the ice making position, the water in the space between the first tray 320 and the second tray 380 may be uniformly distributed to the plurality of first cells 320*b*.

When water passages are provided in the first tray 320 and/or the second tray 380, ice made in the ice making cell 320*a* may also be made in a portion of the water passage.

In this case, when the controller of the refrigerator controls one or more of the cooling power of the cold air supply part 900 and the heating amount of the transparent ice heater to vary according to the mass per unit height of the water in the ice making cell 320*a*, one or more of the cooling power of the cold air supply part 900 and the heating amount of the transparent ice heater may be abruptly changed several times or more in the portion at which the water passage is provided.

This is because the mass per unit height of the water increases more than several times in the portion at which the water passage is provided. In this case, reliability problems of components may occur, and expensive components having large maximum output and minimum output ranges may be used, which may be disadvantageous in terms of power consumption and component costs. As a result, the present invention may require the technique related to the aforementioned ice making position to make the transparent ice.

Figure 7:
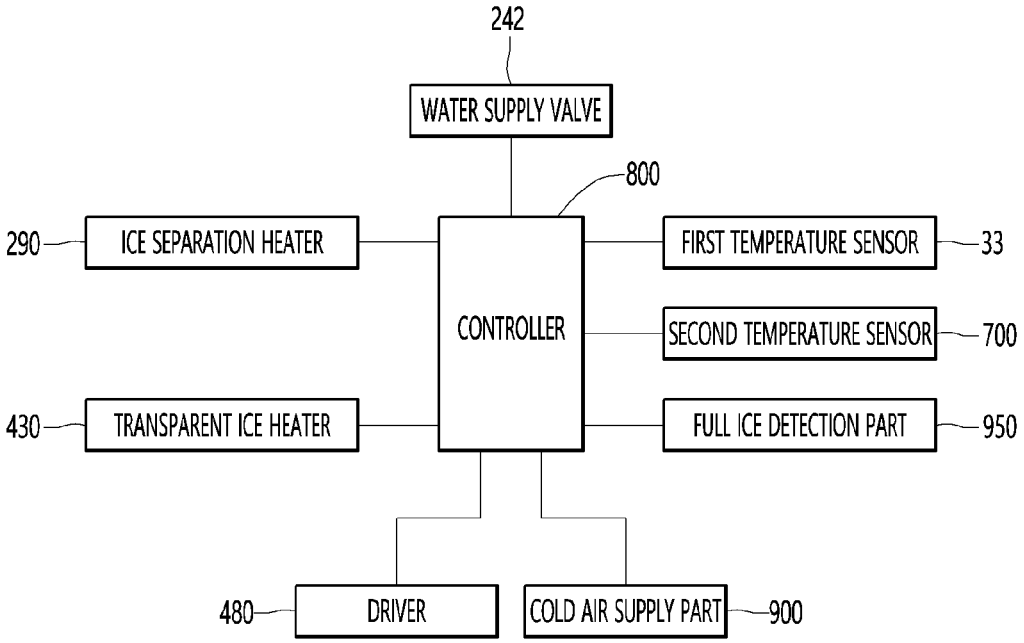
FIG. 7 is a control block diagram of a refrigerator according to an embodiment of the present invention.
Figure 8:
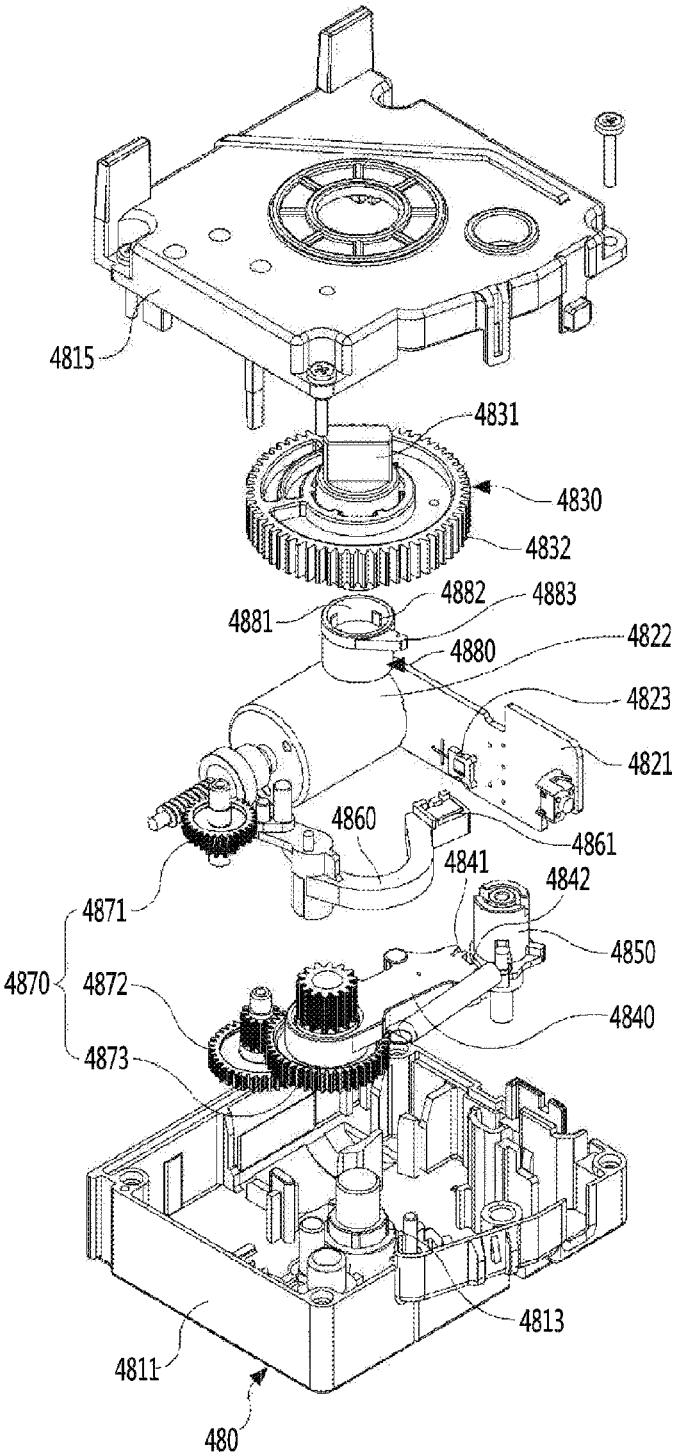
FIG. 8 is an exploded perspective view of a driver according to an embodiment of the present invention.
Figure 9:
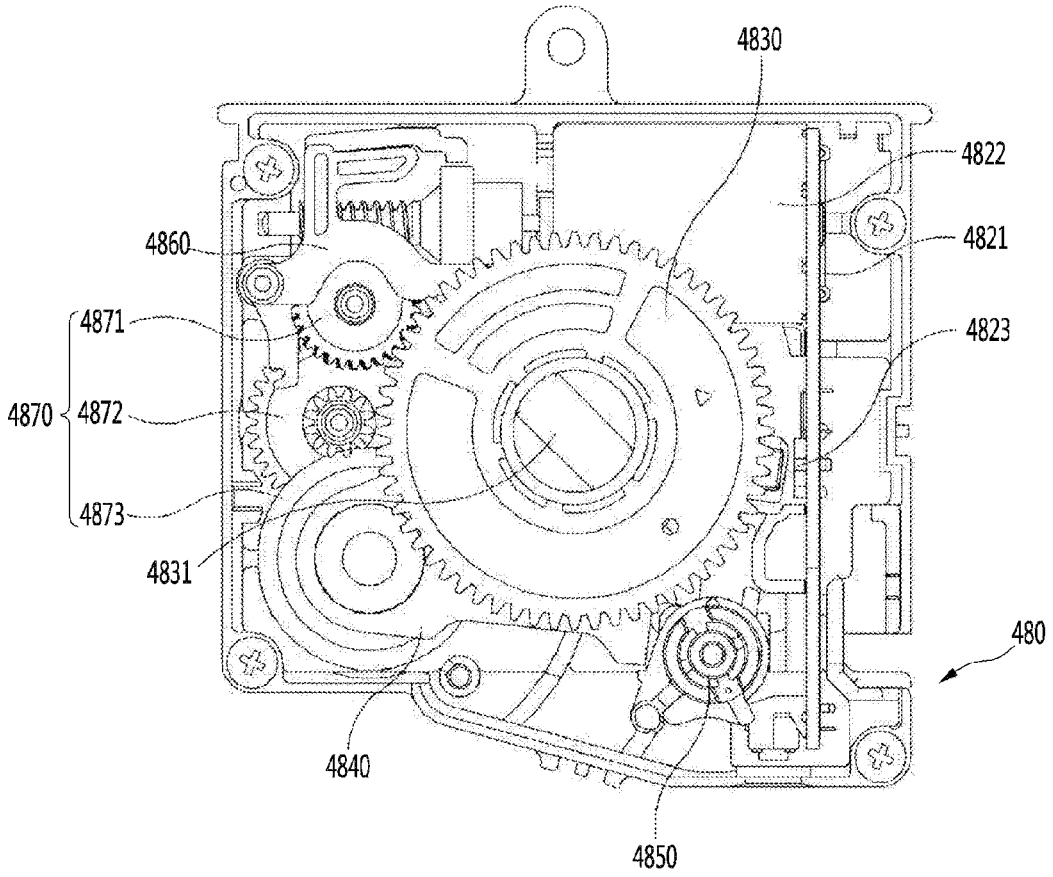
FIG. 9 is a plan view illustrating an internal configuration of the driver.
Figure 10:
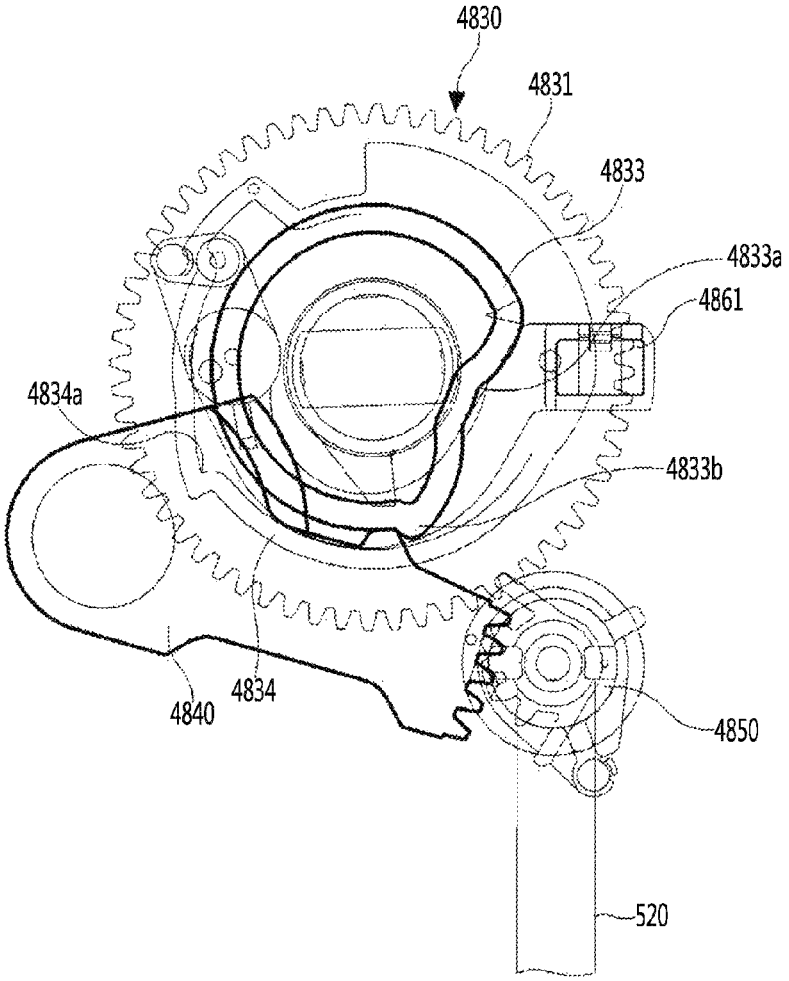
FIG. 10 is a view illustrating a cam and an operation lever of the driver.

FIG. 7 is a control block diagram of a refrigerator according to an embodiment of the present invention, FIG. 8 is an exploded perspective view of a driver according to an embodiment of the present invention, and FIG. 9 is a plan view illustrating an internal configuration of the driver. FIG. 10 is a view illustrating a cam and an operation lever of the driver, and FIG. 11 is a view illustrating a position relationship between a hall sensor and a magnet depending on rotation of the cam.

Figure 11:
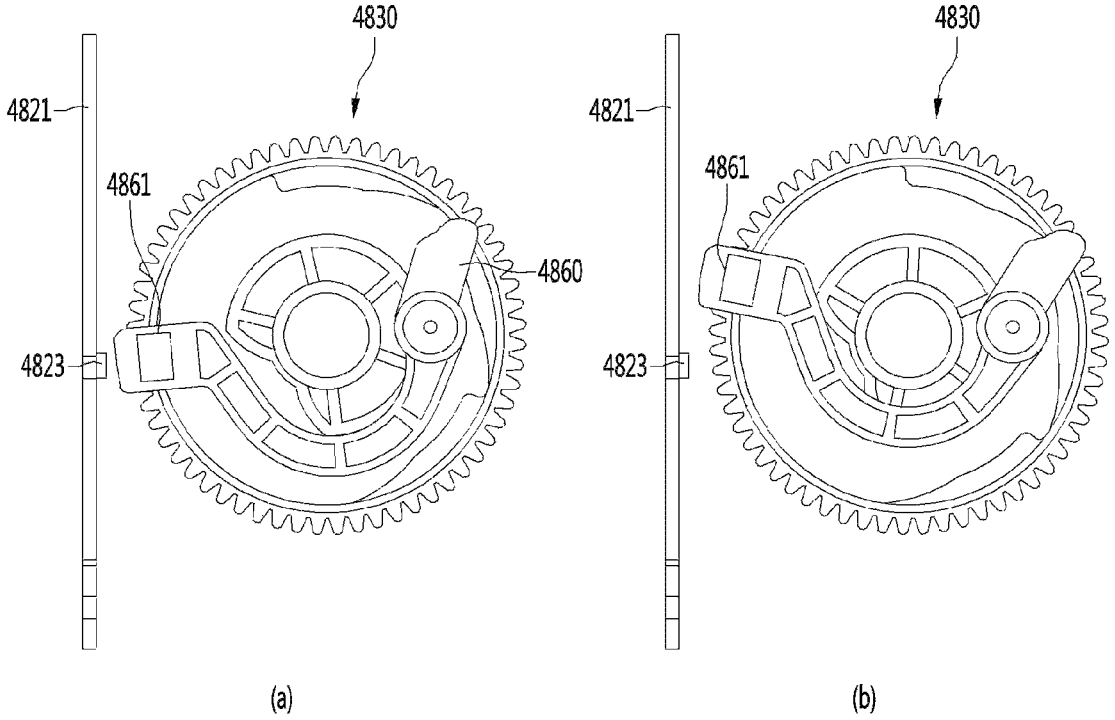
FIG. 11 is a view illustrating a position relationship between a hall sensor and a magnet depending on rotation of the cam.

(a) of FIG. 11 illustrates a state in which the hall sensor and the magnet are aligned at the first position of a magnet lever, and (b) of FIG. 11 illustrates a state in which the hall sensor and the magnet are not aligned at the first position of the magnet lever.

FIGS. 7 to 11, the refrigerator according to this embodiment may include an air supply part 900 supplying cold air to the freezing compartment 32 (or the ice making cell). The cold air supply part 900 may supply cold air to the freezing compartment 32 using a refrigerant cycle.

For example, the cold air supply part 900 may include a compressor compressing the refrigerant. A temperature of the cold air supplied to the freezing compartment 32 may vary according to the output (or frequency) of the compressor. Alternatively, the cold air supply part 900 may include a fan blowing air to an evaporator. An amount of cold air supplied to the freezing compartment 32 may vary according to the output (or rotation rate) of the fan. Alternatively, the cold air supply part 900 may include a refrigerant valve controlling an amount of refrigerant flowing through the refrigerant cycle. An amount of refrigerant flowing through the refrigerant cycle may vary by adjusting an opening degree by the refrigerant valve, and thus, the temperature of the cold air supplied to the freezing compartment 32 may vary.

Therefore, in this embodiment, the cold air supply part 900 may include one or more of the compressor, the fan, and the refrigerant valve.

The refrigerator according to this embodiment may further include a controller 800 that controls the cold air supply part 900. Also, the refrigerator may further include a water supply valve 242 controlling an amount of water supplied through the water supply part 240.

The controller 800 may control a portion or all of the ice separation heater 290, the transparent ice heater 430, the driver 480, the cold air supply part 900, and the water supply valve 242.

In this embodiment, when the ice maker 200 includes both the ice separation heater 290 and the transparent ice heater 430, an output of the ice separation heater 290 and an output of the transparent ice heater 430 may be different from each other. When the outputs of the ice separation heater 290 and the transparent ice heater 430 are different from each other, an output terminal of the ice separation heater 290 and an output terminal of the transparent ice heater 430 may be provided in different shapes, incorrect connection of the two output terminals may be prevented.

Although not limited, the output of the ice separation heater 290 may be set larger than that of the transparent ice heater 430. Accordingly, ice may be quickly separated from the first tray 320 by the ice separation heater 290.

In this embodiment, when the ice separation heater 290 is not provided, the transparent ice heater 430 may be disposed at a position adjacent to the second tray 380 described above or be disposed at a position adjacent to the first tray 320.

The refrigerator may further include a first temperature sensor 33 (or a temperature sensor in the refrigerator) that detects a temperature of the freezing compartment 32.

The controller 800 may control the cold air supply part 900 based on the temperature detected by the first temperature sensor 33. The controller 800 may determine whether the ice making is completed based on the temperature detected by the second temperature sensor 700.

The refrigerator may further include a full ice detection part 950 for detecting full ice of the ice bin 600.

The ice detection part 950 may include, for example, the full ice detection lever 520, a magnet provided in the driver 480, and a hall sensor detecting the magnet.

The driver 480 may include an operation lever 4840 that in organically interlocked by a motor 4822, a cam 4830 rotating by the motor 4822, and a cam surface for the detection lever of the cam 4830.

The driver 480 may further include a lever coupling part 4850 that rotates (swings) the full ice detection lever 520 in the left and right direction while rotating by the operation lever 4840. The driver 480 may include a magnet lever 4860, which is organically interlocked along the cam surface for the magnet of the cam 4830, the motor 4822, the cam 4830, the operation lever 4840, and the lever coupling part 4850, and a case in which the magnet lever 4860 is embedded.

The case may include a first case 4811 in which the motor 4822, the cam 4830, the operation lever 4840, the lever coupling part 4850, and the magnet lever 4860 are embedded, and a second case 4815 that covers the first case 4811. The motor 4822 generates power for rotating the cam 4830.

The driver 480 may further include a control panel 4821 coupled to an inner side of the first case 4811. The motor 4822 may be connected to the control panel 4821.

A hall sensor 4823 may be provided on the control panel 4821. The hall sensor 4824 may output a first signal and a second signal according to a position relative to the magnet lever 4860.

As illustrated in FIG. 10, the cam 4830 may include a coupling part 4831 to which the rotation arm 460 is coupled. The coupling part 4831 serves as a rotation shaft of the cam 4830.

The cam 4830 may include a gear 4832 to transmit power to the motor 4822. The gear 4832 may be formed on an outer circumferential surface of the cam 4830. The cam 4830 may include a cam surface 4833 for the detection lever and a cam surface 4834 for the magnet. That is, the cam 4830 forms a path through which the levers 4840 and 4860 move. A cam groove **4833*a* for the detection lever, which rotates the full ice detection lever 520 by lowering the operation lever 4840 is formed in the cam surface 4833** for the detection lever.

A cam groove **4834*a* for the magnet, which lowers the magnet lever 4860 so that the magnet lever 4860 and the hall sensor 423 are separated from each other is formed in the cam surface 4834** for the magnet.

A reduction gear 4870 that reduces rotational force of the motor 4822 to transmit the rotational force to the cam 4830 may be provided between the cam 4830 and the motor 4822. The reduction gear 4870 may include a first reduction gear 4871 connected to the motor 4822 to transmit power, a second reduction gear 4872 engaged with the first reduction gear 4871, and a third reduction gear 4873 connecting the second reduction gear 4872 to the cam 4830 to transmit the power.

One end of the operation lever 4840 is fitted and coupled to the rotation shaft of the third reduction gear 4873 so as to be freely rotatable, and a gear 4882 formed at the other end of the operation lever 4840 is connected to the lever coupling part 4850 so as to transmit the power. That is, when the operation lever 4840 move, the lever coupling part 4850 rotates.

The lever coupling part 4850 has one end rotatably connected to the operation lever 4840 inside the case and the other end protruding to the outside of the case so as to be coupled to the full ice detection lever 520.

The magnet lever 4860 may include a central portion rotatably provided on the case, an end that is organically interlocked along the cam surface 4834 for the magnet of the cam 4830, and a magnet 4861 that is aligned with the hall sensor 4824 or spaced apart from the hall sensor 4823.

As illustrated in (a) of FIG. 11, when the magnet 4881 is aligned with the hall sensor 4824, any one of the first signal and the second signal may be output from the hall sensor 4824.

As illustrated in (b) of FIG. 11, when the magnet 4881 is out of the position facing the hall sensor 4824, the other signal of the first signal and the second signal is output from the hall sensor 4824.

A blocking member 4880 that selectively blocks the cam groove **4833*a* for the detection lever so that the operation lever 4840 moving along the cam surface 4833 for the detection lever is not inserted into the cam groove 4833*a* for the detection lever when the full ice detection lever 500 returns to its original position may be provided on the rotation shaft of the cam 4830**.

That is, the blocking member 4880 may include a coupling part 4881 rotatably coupled to the rotation shaft of the cam 4830 and a hook groove 4882 formed in one side of the coupling part 4881 and coupled to the protrusion 4813 formed on the bottom surface of the case to restrict a rotation angle of the coupling part 4881.

The blocking member 4880 may further include a support protrusion 4883 that is provided outside the coupling part 4881 to restrict an operation of the operation lever 4840 so that the operation lever 4840 is not inserted into the cam groove 4833*a* for the detection lever while being supported on or separated from the operation lever 4840 when the cam gear rotates in the forward or reverse direction.

The driver 480 may further include an elastic member that provides elastic force so that the lever coupling part 4850 rotates in one direction. One end of the elastic member may be connected to the lever coupling part 4850, and the other end may be fixed to the case.

A protrusion 4833*b* may be provided between the cam surface 4833 for the detection lever of the cam 4830 and the cam groove 4833*a*.

In this embodiment, the cam surface 4833 for the detection lever may be designed, for example, so that, in the process in which the second tray 380 (or the full ice detection lever 520) moves from the ice making position to the water supply position, a first signal is output from the sensor 4823, and when the second tray 380 moves to the water supply position, a second signal is output from the sensor 4823.

Also, the cam surface 4833 for the detection lever may be designed, for example, so that, in the process in which the second tray 380 moves from the water supply position to the ice making position, a second signal is output from the sensor 4823, and when the second tray 380 moves to the full ice detection position, a first signal is output from the sensor 4823.

Also, the cam surface 4833 for the detection lever may be designed, for example, in the process in which the second tray 380 moves from the full ice detection position to the ice separation position, a second signal is output from the sensor 4823, and when the second tray 380 moves to the ice separation position, a first signal is output from the sensor 4823.

The controller 800 may determine that the ice bin is not full when, for example, the first signal is output for a predetermined time from the hall sensor 4823 after the second tray 380 passes through the water supply position in the ice separation process.

On the other hand, the controller 800 may determine that the ice bin is full when the first signal is not output from the sensor 4823 for a reference time after the second tray 380 passes through the water supply position, or the second signal is continuously output from the hall sensor 4823 for the reference time in the ice separation process.

As another example, the full ice detection part 950 may include a light emitting part and a light receiving part, which are provided in the ice bin 600. In this case, the full ice detection lever 520 may be omitted. When light irradiated from the light emitting part reaches the light receiving part, it may be determined as no full ice. If the light irradiated from the light emitting part does not reach the light receiving part, it may be determined as full ice. In this case, the light emitting part and the light receiving part may be provided in the ice maker. In this case, the light emitting part and the light receiving part may be disposed in the ice bin.

As described above, since the type of signals and time, which are output from the hall sensor 4824 for each position of the second tray 380 are different from each other, the controller 800 may accurately determine the current position of the second tray 380.

When the full ice detection lever 520 is disposed at the full ice detection position, the second tray 380 may also be described as being disposed at the full ice detection position.

Figure 13:
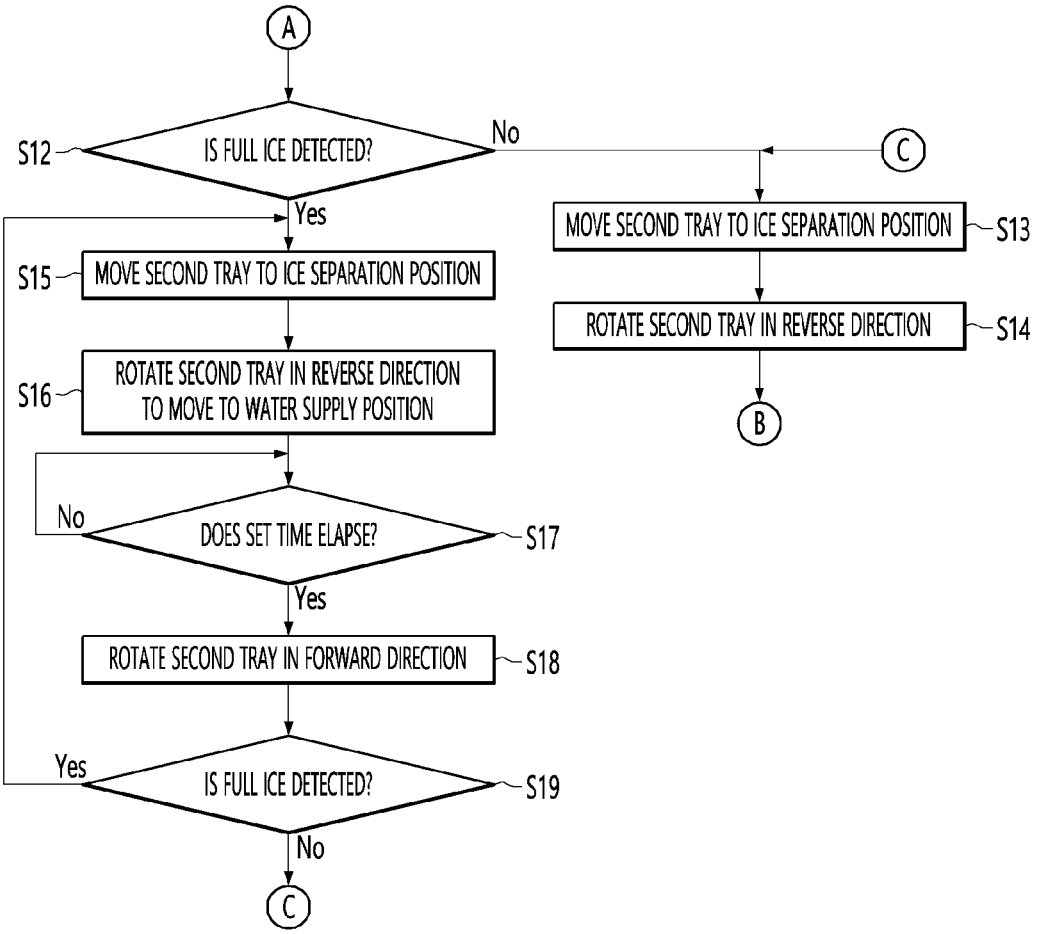

FIGS. 12 and 13 are flowcharts for explaining a process of making ice in the ice maker according to an embodiment of the present invention.

Figure 14:
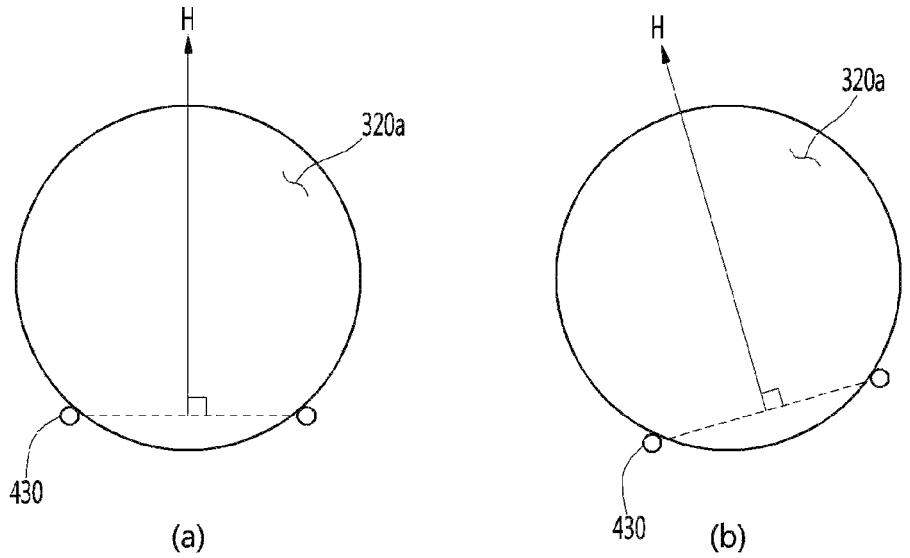
FIG. 14 is a view for explaining a height reference depending on a relative position of the transparent heater with respect to the ice making cell.
Figure 15:
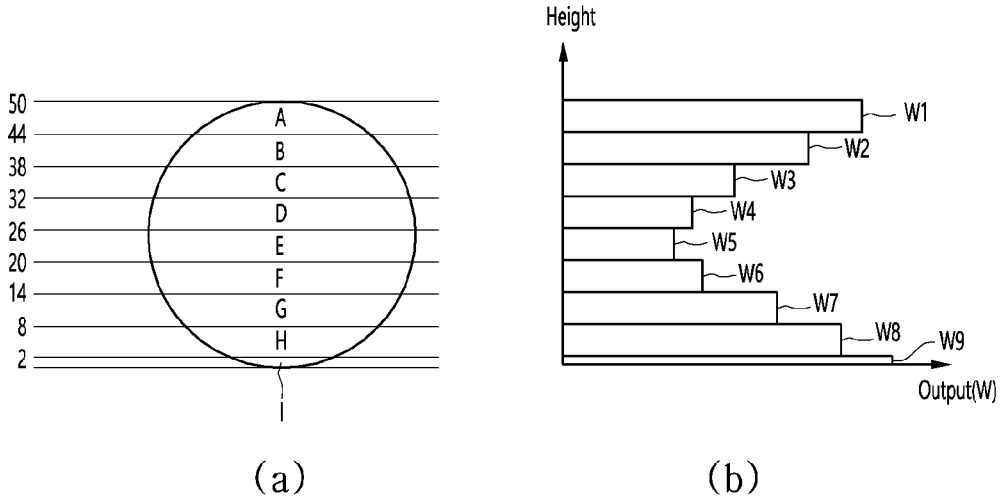
FIG. 15 is a view for explaining an output of the transparent heater per unit height of water within the ice making cell.

FIG. 14 is a view for explaining a height reference depending on a relative position of the transparent heater with respect to the ice making cell, and FIG. 15 is a view for explaining an output of the transparent heater per unit height of water within the ice making cell.

Figure 16:
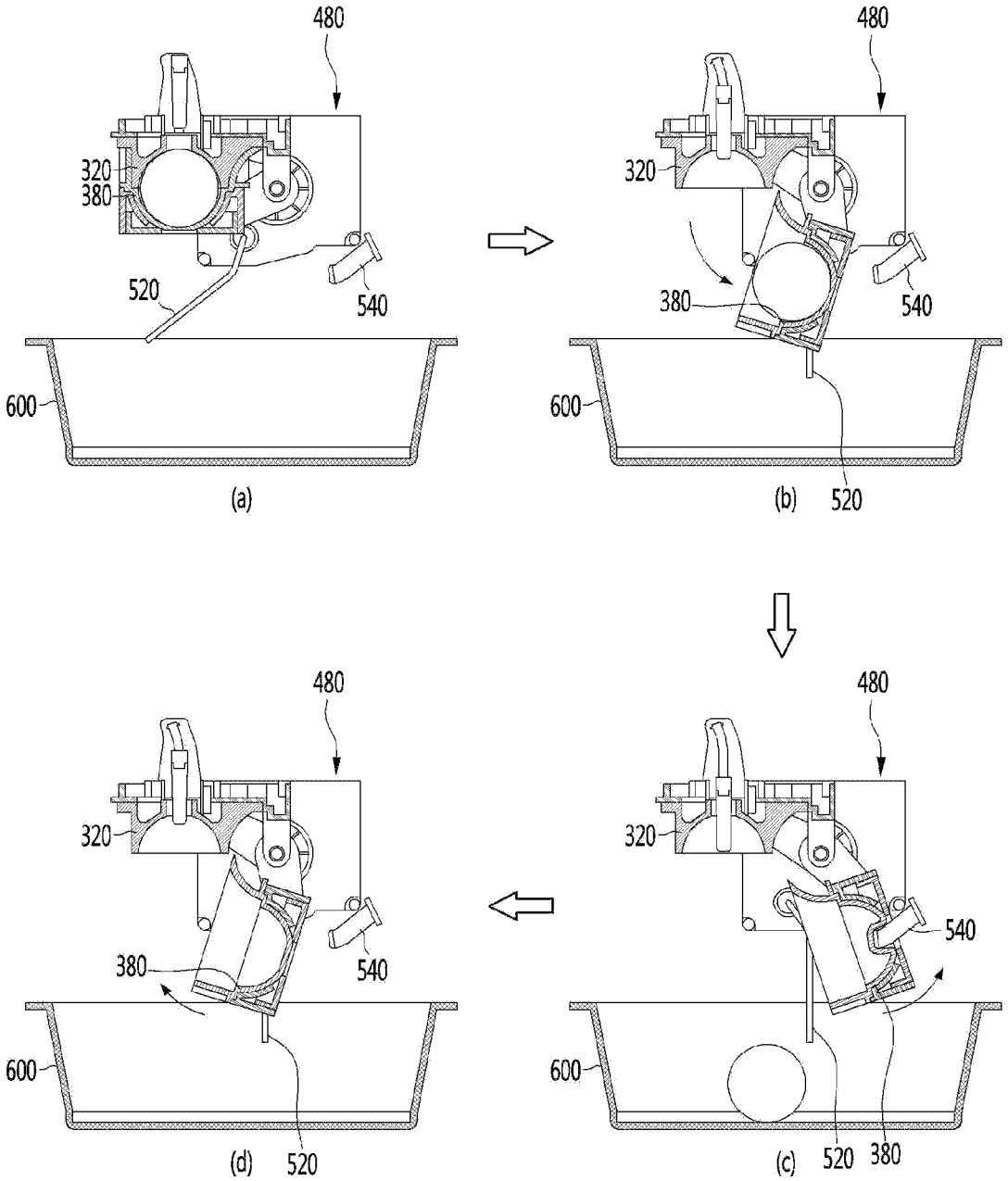
FIG. 16 is a view illustrating movement of a second tray when full ice is not detected in an ice separation process.
Figure 17:
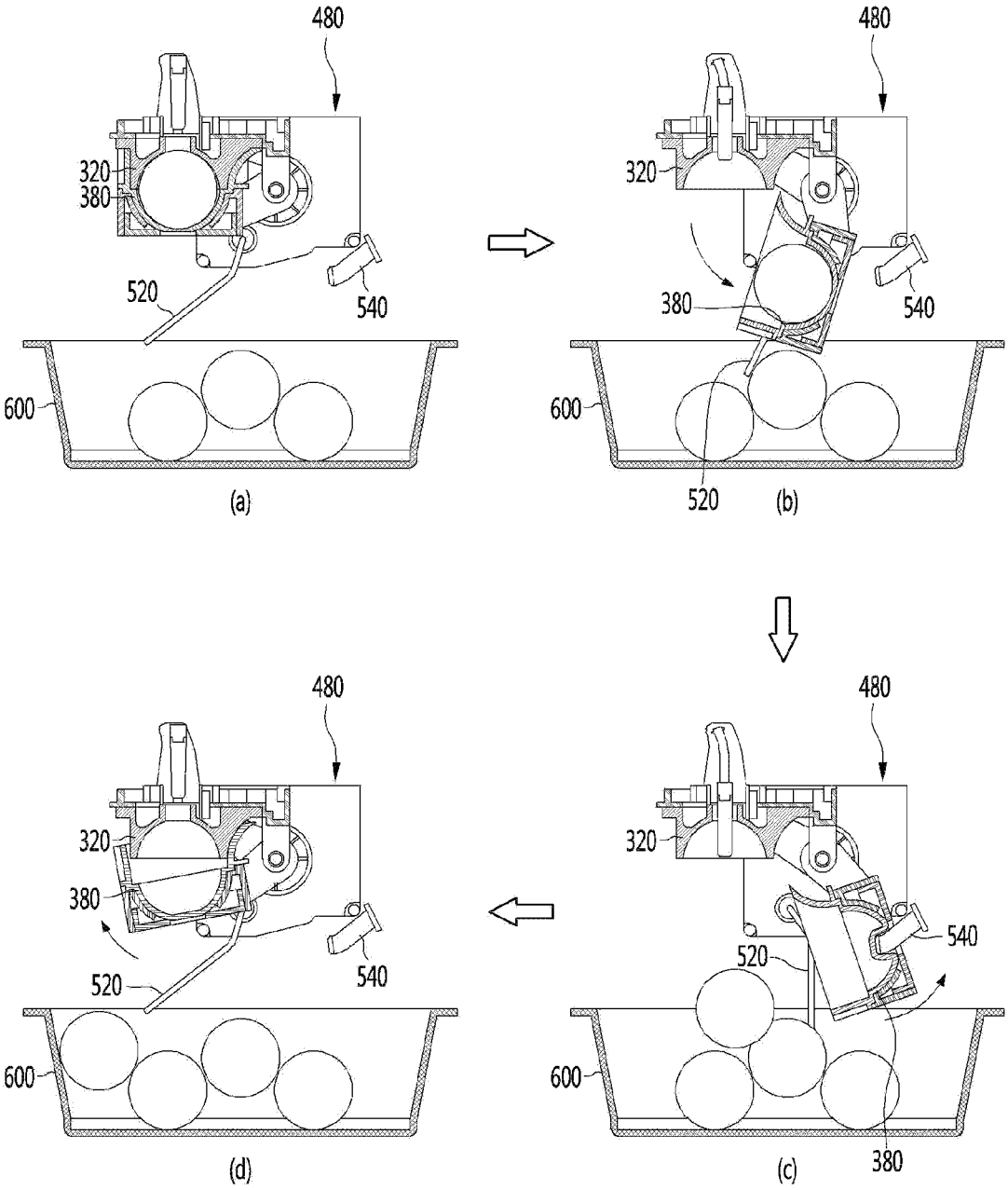
FIG. 17 is a view illustrating movement of the second tray when the full ice is detected in the ice separation process.
Figure 18:
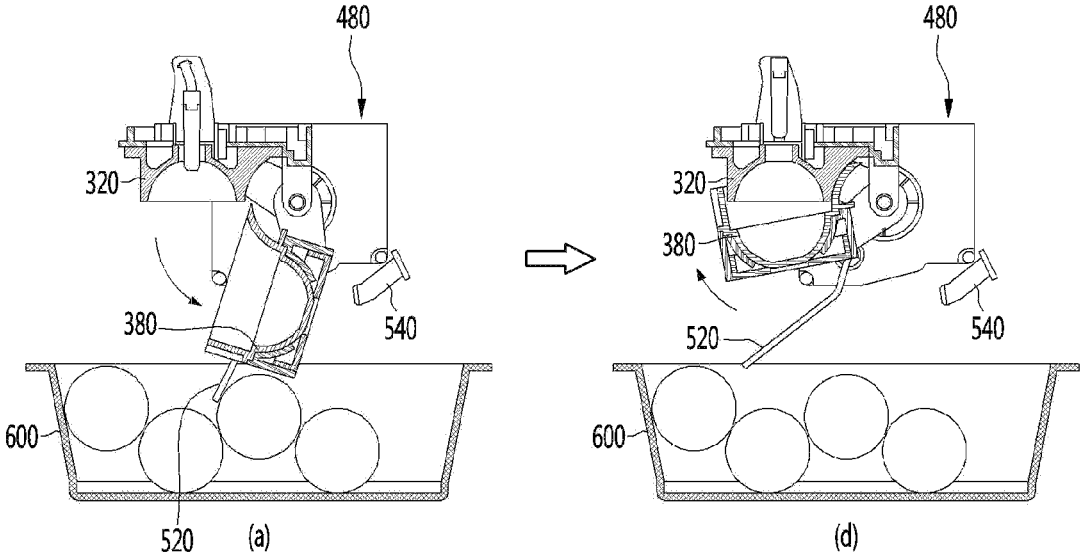
FIG. 18 is a view illustrating movement of the second tray when full ice is detected again after the full ice is detected.

FIG. 16 is a view illustrating movement of a second tray when full ice is not detected in an ice separation process, FIG. 17 is a view illustrating movement of the second tray when the full ice is detected in the ice separation process, and FIG. 18 is a view illustrating movement of the second tray when full ice is detected again after the full ice is detected.

(a) of FIG. 16 illustrates a state in which the second tray moves to the ice making position, (b) of FIG. 16 illustrates a state in which the second tray and the full ice detection lever move to the full ice detection position, and (c) of FIG. 16 illustrates a state in which the second tray moves to the ice separation position. (d) of FIG. 17 illustrates a state in which the second tray moves to the water supply position.

Referring to FIGS. 10 to 18, to make ice in the ice maker 200, the controller 800 moves the second tray 380 to a water supply position (S1).

In this specification, a direction in which the second tray 380 moves from the ice making position in (a) of FIG. 16 to the ice separation position in (c) of FIG. 16 may be referred to as forward movement (or forward rotation). On the other hand, the direction from the ice separation position in (c) of FIG. 16 to the water supply position in (d) of FIG. 17 may be referred to as reverse movement (or reverse rotation).

When it is detected that the second tray 380 move to the water supply position, the controller 800 stops an operation of the driver 480.

In the state in which the second tray 380 moves to the water supply position, the water supply starts (S2). For the water supply, the controller 800 turns on the water supply valve 242, and when it is determined that a first water supply amount is supplied, the controller 800 may turn off the water supply valve 242. For example, in the process of supplying water, when a pulse is outputted from a flow sensor (not shown), and the outputted pulse reaches a reference pulse, it may be determined that water as much as the water supply amount is supplied.

After the water supply is completed, the controller 800 controls the driver 480 to allow the second tray 380 to move to the ice making position (S3). For example, the controller 800 may control the driver 480 to allow the second tray 380 to move from the water supply position in the reverse direction. When the second tray 380 move in the reverse direction, the top surface 381*a* of the second tray 380 comes close to the bottom surface 321*e* of the first tray 320. Then, water between the top surface 381*a* of the second tray 380 and the bottom surface 321*e* of the first tray 320 is divided into each of the plurality of second cells 320*c* and then is distributed. When the top surface 381*a* of the second tray 380 and the bottom surface 321*e* of the first tray 320 contact each other, water is filled in the first cell 320*b*.

The movement to the ice making position of the second tray 380 is detected by a sensor, and when it is detected that the second tray 380 moves to the ice making position, the controller 800 stops the driver 480.

In the state in which the second tray 380 moves to the ice making position, ice making is started (S4). For example, the ice making may be started when the second tray 380 reaches the ice making position. Alternatively, when the second tray 380 reaches the ice making position, and the water supply time elapses, the ice making may be started.

When ice making is started, the controller 800 may control the cold air supply part 900 to supply cold air to the ice making cell 320*a*.

After the ice making is started, the controller 800 may control the transparent ice heater 430 to be turned on in at least partial sections of the cold air supply part 900 supplying the cold air to the ice making cell 320*a*.

When the transparent ice heater 430 is turned on, since the heat of the transparent ice heater 430 is transferred to the ice making cell 320*a*, the ice making rate of the ice making cell 320*a* may be delayed.

According to this embodiment, the ice making rate may be delayed so that the bubbles dissolved in the water inside the ice making cell 320*a* move from the portion at which ice is made toward the liquid water by the heat of the transparent ice heater 430 to make the transparent ice in the ice maker 200.

In the ice making process, the controller 800 may determine whether the turn-on condition of the transparent ice heater 430 is satisfied (S5).

In this embodiment, the transparent ice heater 430 is not turned on immediately after the ice making is started, and the transparent ice heater 430 may be turned on only when the turn-on condition of the transparent ice heater 430 is satisfied (S6).

Generally, the water supplied to the ice making cell 320*a* may be water having normal temperature or water having a temperature lower than the normal temperature. The temperature of the water supplied is higher than a freezing point of water. Thus, after the water supply, the temperature of the water is lowered by the cold air, and when the temperature of the water reaches the freezing point of the water, the water is changed into ice.

In this embodiment, the transparent ice heater 430 may not be turned on until the water is phase-changed into ice.

If the transparent ice heater 430 is turned on before the temperature of the water supplied to the ice making cell 320*a* reaches the freezing point, the speed at which the temperature of the water reaches the freezing point by the heat of the transparent ice heater 430 is slow. As a result, the starting of the ice making may be delayed.

The transparency of the ice may vary depending on the presence of the air bubbles in the portion at which ice is made after the ice making is started. If heat is supplied to the ice making cell 320*a* before the ice is made, the transparent ice heater 430 may operate regardless of the transparency of the ice.

Thus, according to this embodiment, after the turn-on condition of the transparent ice heater 430 is satisfied, when the transparent ice heater 430 is turned on, power consumption due to the unnecessary operation of the transparent ice heater 430 may be prevented.

Alternatively, even if the transparent ice heater 430 is turned on immediately after the start of ice making, since the transparency is not affected, it is also possible to turn on the transparent ice heater 430 after the start of the ice making.

In this embodiment, the controller 800 may determine that the turn-on condition of the transparent ice heater 430 is satisfied when a predetermined time elapses from the set specific time point. The specific time point may be set to at least one of the time points before the transparent ice heater 430 is turned on. For example, the specific time point may be set to a time point at which the cold air supply part 900 starts to supply cooling power for the ice making, a time point at which the second tray 380 reaches the ice making position, a time point at which the water supply is completed, and the like.

Alternatively, the controller 800 determines that the turn-on condition of the transparent ice heater 430 is satisfied when a temperature detected by the second temperature sensor 700 reaches a turn-on reference temperature.

For example, the turn-on reference temperature may be a temperature for determining that water starts to freeze at the uppermost side (communication hole-side) of the ice making cell 320*a*.

When a portion of the water is frozen in the ice making cell 320*a*, the temperature of the ice in the ice making cell 320*a* is below zero.

The temperature of the first tray 320 may be higher than the temperature of the ice in the ice making cell 320*a*.

Alternatively, although water exists in the ice making cell 320*a*, after the ice starts to be made in the ice making cell 320*a*, the temperature detected by the second temperature sensor 700 may be below zero.

Thus, to determine that making of ice is started in the ice making cell 320*a* on the basis of the temperature detected by the second temperature sensor 700, the turn-on reference temperature may be set to the below-zero temperature.

That is, when the temperature detected by the second temperature sensor 700 reaches the turn-on reference temperature, since the turn-on reference temperature is below zero, the ice temperature of the ice making cell 320*a* is below zero, i.e., lower than the below reference temperature. Therefore, it may be indirectly determined that ice is made in the ice making cell 320*a*.

As described above, when the transparent ice heater 430 is not used, the heat of the transparent ice heater 430 is transferred into the ice making cell 320*a*.

In this embodiment, when the second tray 380 is disposed below the first tray 320, the transparent ice heater 430 is disposed to supply the heat to the second tray 380, the ice may be made from an upper side of the ice making cell 320*a*.

In this embodiment, since ice is made from the upper side in the ice making cell 320*a*, the bubbles move downward from the portion at which the ice is made in the ice making cell 320*a* toward the liquid water.

Since density of water is greater than that of ice, water or bubbles may be convex in the ice making cell 320*a*, and the bubbles may move to the transparent ice heater 430.

In this embodiment, the mass (or volume) per unit height of water in the ice making cell 320*a* may be the same or different according to the shape of the ice making cell 320*a*. For example, when the ice making cell 320*a* is a rectangular parallelepiped, the mass (or volume) per unit height of water in the ice making cell 320*a* is the same. On the other hand, when the ice making cell 320*a* has a shape such as a sphere, an inverted triangle, a crescent moon, etc., the mass (or volume) per unit height of water is different.

If the cooling power of the cold air supply part 900 is constant, if the heating amount of the transparent ice heater 430 is the same, since the mass per unit height of water in the ice making cell 320*a* is different, an ice making rate per unit height may be different.

For example, if the mass per unit height of water is small, the ice making rate is high, whereas if the mass per unit height of water is high, the ice making rate is slow.

As a result, the ice making rate per unit height of water is not constant, and thus, the transparency of the ice may vary according to the unit height. In particular, when ice is made at a high rate, the bubbles may not move from the ice to the water, and the ice may contain the bubbles to lower the transparency.

That is, the more the variation in ice making rate per unit height of water decreases, the more the variation in transparency per unit height of made ice may decrease.

Therefore, in this embodiment, the controller 800 may control the cooling power and/or the heating amount so that the cooling power of the cold air supply part 900 and/or the heating amount of the transparent ice heater 430 is variable according to the mass per unit height of the water of the ice making cell 320*a*.

In this specification, the variable of the cooling power of the cold air supply part 900 may include one or more of a variable output of the compressor, a variable output of the fan, and a variable opening degree of the refrigerant valve.

Also, in this specification, the variation in the heating amount of the transparent ice heater 430 may represent varying the output of the transparent ice heater 430 or varying the duty of the transparent ice heater 430.

In this case, the duty of the transparent ice heater 430 represents a ratio of the turn-on time and the turn-off time of the transparent ice heater 430 in one cycle, or a ratio of the turn-on time and the turn-off time of the transparent ice heater 430 in one cycle.

In this specification, a reference of the unit height of water in the ice making cell 320*a* may vary according to a relative position of the ice making cell 320*a* and the transparent ice heater 430.

For example, as shown in (a) of FIG. 14, the transparent ice heater 430 at the bottom surface of the ice making cell 320*a* may be disposed to have the same height.

In this case, a line connecting the transparent ice heater 430 is a horizontal line, and a line extending in a direction perpendicular to the horizontal line serves as a reference for the unit height of the water of the ice making cell 320*a*.

In the case of (a) of FIG. 14, ice is made from the uppermost side of the ice making cell 320*a* and then is grown. On the other hand, as illustrated in (b) of FIG. 14, the transparent ice heater 430 at the bottom surface of the ice making cell 320*a* may be disposed to have different heights.

In this case, since heat is supplied to the ice making cell 320*a* at different heights of the ice making cell 320*a*, ice is made with a pattern different from that of (a) of FIG. 14.

For example, in (b) of FIG. 14, ice may be made at a position spaced apart from the uppermost side to the left side of the ice making cell 320*a*, and the ice may be grown to a right lower side at which the transparent ice heater 430 is disposed.

Accordingly, in (b) of FIG. 14, a line (reference line) perpendicular to the line connecting two points of the transparent ice heater 430 serves as a reference for the unit height of water of the ice making cell 320*a*. The reference line of (b) of FIG. 14 is inclined at a predetermined angle from the vertical line.

FIG. 15 illustrates a unit height division of water and an output amount of transparent ice heater per unit height when the transparent ice heater is disposed as shown in (a) of FIG. 14.

Hereinafter, an example of controlling an output of the transparent ice heater so that the ice making rate is constant for each unit height of water will be described.

Referring to FIG. 15, when the ice making cell 320*a* is formed, for example, in a spherical shape, the mass per unit height of water in the ice making cell 320*a* increases from the upper side to the lower side to reach the maximum and then decreases again.

For example, the water (or the ice making cell itself) in the spherical ice making cell 320*a* having a diameter of about 50 mm is divided into nine sections (section A to section I) by 6 mm height (unit height). Here, it is noted that there is no limitation on the size of the unit height and the number of divided sections.

When the water in the ice making cell 320*a* is divided into unit heights, the height of each section to be divided is equal to the section A to the section H, and the section I is lower than the remaining sections. Alternatively, the unit heights of all divided sections may be the same depending on the diameter of the ice making cell 320*a* and the number of divided sections.

Among the plurality of sections, the section E is a section in which the mass of unit height of water is maximum. For example, in the section in which the mass per unit height of water is maximum, when the ice making cell 320*a* has spherical shape, a diameter of the ice making cell 320*a*, a horizontal cross-sectional area of the ice making cell 320*a*, or a circumference of the ice are maximized.

As described above, when assuming that the cooling power of the cold air supply part 900 is constant, and the output of the transparent ice heater 430 is constant, the ice making rate in section E is the lowest, the ice making rate in the sections A and I is the fastest.

In this case, since the ice making rate varies for the height, the transparency of the ice may vary for the height. In a specific section, the ice making rate may be too fast to contain bubbles, thereby lowering the transparency.

Therefore, in this embodiment, the output of the transparent ice heater 430 may be controlled so that the ice making rate for each unit height is the same or similar while the bubbles move from the portion at which ice is made to the water in the ice making process.

Specifically, since the mass of the section E is the largest, the output W5 of the transparent ice heater 430 in the section E may be set to a minimum value. Since the volume of the section D is less than that of the section E, the volume of the ice may be reduced as the volume decreases, and thus it is necessary to delay the ice making rate. Thus, an output W6 of the transparent ice heater 430 in the section D may be set to a value greater than an output W5 of the transparent ice heater 430 in the section E.

Since the volume in the section C is less than that in the section D by the same reason, an output W3 of the transparent ice heater 430 in the section C may be set to a value greater than the output W4 of the transparent ice heater 430 in the section D.

Since the volume in the section B is less than that in the section C, an output W2 of the transparent ice heater 430 in the section B may be set to a value greater than the output W3 of the transparent ice heater 430 in the section C. Also, since the volume in the section A is less than that in the section B, an output W1 of the transparent ice heater 430 in the section A may be set to a value greater than the output W2 of the transparent ice heater 430 in the section B. For the same reason, since the mass per unit height decreases toward the lower side in the section E, the output of the transparent ice heater 430 may increase as the lower side in the section E (see W6, W7, W8, and W9).

Thus, according to an output variation pattern of the transparent ice heater 430, the output of the transparent ice heater 430 is gradually reduced from the first section to the intermediate section after the transparent ice heater 430 is initially turned on.

The output of the transparent ice heater 430 may be minimum in the intermediate section in which the mass of unit height of water is minimum. The output of the transparent ice heater 430 may again increase step by step from the next section of the intermediate section.

The transparency of the ice may be uniform for each unit height, and the bubbles may be collected in the lowermost section by the output control of the transparent ice heater 430. Thus, when viewed on the ice as a whole, the bubbles may be collected in the localized portion, and the remaining portion may become totally transparent.

As described above, even if the ice making cell 320*a* does not have the spherical shape, the transparent ice may be made when the output of the transparent ice heater 430 varies according to the mass for each unit height of water in the ice making cell 320*a*.

The heating amount of the transparent ice heater 430 when the mass for each unit height of water is large may be less than that of the transparent ice heater 430 when the mass for each unit height of water is small.

For example, while maintaining the same cooling power of the cold air supply part 900, the heating amount of the transparent ice heater 430 may vary so as to be inversely proportional to the mass per unit height of water.

Also, it is possible to make the transparent ice by varying the cooling power of the cold air supply part 900 according to the mass per unit height of water.

For example, when the mass per unit height of water is large, the cold force of the cold air supply part 900 may increase, and when the mass per unit height is small, the cold force of the cold air supply part 900 may decrease.

For example, while maintaining a constant heating amount of the transparent ice heater 430, the cooling power of the cold air supply part 900 may vary to be proportional to the mass per unit height of water.

Referring to the variable cooling power pattern of the cold air supply part 900 in the case of making the spherical ice, the cooling power of the cold air supply part 900 from the initial section to the intermediate section during the ice making process may increase step by step.

The cooling power of the cold air supply part 900 may be maximum in the intermediate section in which the mass for each unit height of water is minimum. The cooling power of the cold air supply part 900 may be reduced again step by step from the next section of the intermediate section.

Alternatively, the transparent ice may be made by varying the cooling power of the cold air supply part 900 and the heating amount of the transparent ice heater 430 according to the mass for each unit height of water.

For example, the heating power of the transparent ice heater 430 may vary so that the cooling power of the cold air supply part 900 is proportional to the mass per unit height of water and inversely proportional to the mass for each unit height of water.

According to this embodiment, when one or more of the cooling power of the cold air supply part 900 and the heating amount of the transparent ice heater 430 are controlled according to the mass per unit height of water, the ice making rate per unit height of water may be substantially the same or may be maintained within a predetermined range.

The controller 800 may determine whether the ice making is completed based on the temperature detected by the second temperature sensor 700 (S8). When it is determined that the ice making is completed, the controller 800 may turn off the transparent ice heater 430 (S9).

For example, when the temperature detected by the second temperature sensor 700 reaches a first reference temperature, the controller 800 may determine that the ice making is completed to turn off the transparent ice heater 430.

In this case, since a distance between the second temperature sensor 700 and each ice making cell 320*a* is different, in order to determine that the ice making is completed in all the ice making cells 320*a*, the controller 800 may perform the ice separation after a certain amount of time, at which it is determined that ice making is completed, has passed or when the temperature detected by the second temperature sensor 700 reaches a second reference temperature lower than the first reference temperature.

Of course, when the transparent ice heater 430 is turned off, it is also possible to start the ice separation immediately.

When the ice making is completed, the controller 800 operates one or more of the ice maker heater 290 and the transparent ice heater 430 (S10).

When one or more of the ice separation heater 290 and the transparent ice heater 430 are turned on, heat of the heaters 290 and 430 is transferred to one or more of the first tray 320 and the second tray 380 so that the ice is separated from the surfaces (inner surfaces) of one or more of the first tray 320 and the second tray 380.

Also, the heat of the heaters 290 and 430 is transferred to the contact surface of the first tray 320 and the second tray 380, and thus, the bottom surface 321*d* of the first tray and the top surface 381*a* of the second tray 380 may be in a state capable of being separated from each other.

When one or more of the ice separation heater 290 and the transparent ice heater 430 operate for a predetermined time, or when the temperature detected by the second temperature sensor 700 is equal to or higher than a turn-off reference temperature, the controller 800 is turned off the heaters 290 and 430, which are turned on.

Although not limited, the turn-off reference temperature may be set to above zero temperature.

For the ice separation, the controller 800 operates the driver 480 to allow the second tray 380 to move in the forward direction (S12).

As illustrated in FIG. 16, when the second tray 380 move in the forward direction, the second tray 380 is spaced apart from the first tray 320.

The moving force of the second tray 380 is transmitted to the first pusher 260 by the pusher link 500. Then, the first pusher 260 descends along the guide slot 302, and the extension part 264 passes through the communication hole 321*e* to press the ice in the ice making cell 320*a*.

In this embodiment, ice may be separated from the first tray 320 before the extension part 264 presses the ice in the ice making process. That is, ice may be separated from the surface of the first tray 320 by the heater that is turned on. In this case, the ice may move together with the second tray 380 while the ice is supported by the second tray 380.

For another example, even when the heat of the heater is applied to the first tray 320, the ice may not be separated from the surface of the first tray 320.

Therefore, when the second tray 380 moves in the forward direction, there is possibility that the ice is separated from the second tray 380 in a state in which the ice contacts the first tray 320.

In this state, in the process of moving the second tray 380, the extension part 264 passing through the communication hole 320*e* may press the ice contacting the first tray 320, and thus, the ice may be separated from the tray 320. The ice separated from the first tray 320 may be supported again by the second tray 380.

When the ice moves together with the second tray 380 while the ice is supported by the second tray 380, the ice may be separated from the tray 250 by its own weight even if no external force is applied to the second tray 380.

While the second tray 380 moves, even if the ice does not fall from the second tray 380 by its own weight, when the second tray 380 is pressed by the second pusher 540 as illustrated in FIG. 16, the ice may be separated from the second tray 380 to fall downward.

Particularly, while the second tray 380 moves, the second tray 380 may contact the extension part 544 of the second pusher 540.

When the second tray 380 continuously moves in the forward direction, the extension part 544 may press the second tray 380 to deform the second tray 380 and the extension part 544. Thus, the pressing force of the extension part 544 may be transferred to the ice so that the ice is separated from the surface of the second tray 380.

The ice separated from the surface of the second tray 380 may drop downward and be stored in the ice bin 600.

In this embodiment, in the state in which the second tray 380 move to the ice separation position, the second tray 380 may be pressed by the second pusher 540 and thus be changed in shape.

Whether the ice bin 600 is full may be detected while the second tray 380 moves from the ice making position to the ice separation position (S12).

As an example, while the full ice detection lever 520 rotates together with the second tray 380, when the full ice detection lever 520 moves to the full ice detection position, the first signal is output from the hall sensor 4823 as described above, and thus, it may be determined that the ice bin 600 is not full.

In the state in which the full ice detection lever 520 moves to the full ice detection position, the first body 521 of the full ice detection lever 520 is disposed in the ice bin 600. In this case, a maximum distance from an upper end of the ice bin 600 to the first body 521 may be set to be less than a radius of ice generated in the ice making cell 320*a*. This means that the first body 521 lifts the ice stored in the ice bin 600 while the full ice detection lever 520 moves to the full ice detection position so that the ice is discharged from the ice bin 600.

Also, the first body 521 may be disposed lower than the second tray 380 and be spaced apart from the second tray 380 in the process of rotating the full ice detection lever 520 so that an interference between the full ice detection lever 520 and the second tray 380 is prevented.

On the other hand, in the process of rotating the full ice detection lever 520, before the full ice detection lever 520 moves to the full ice detection position, if the full ice detection lever 520 interferes with ice, the first signal is not output from the hall sensor 4823.

Thus, the controller 800 may determine that the ice bin is full when the first signal is not output from the hall sensor 4823 for a reference time, or the second signal is continuously output from the sensor 4823 for the reference time in the ice separation process.

If it is determined that the ice bin 600 is not full, the controller 800 controls the driver 480 to allow the second tray 380 to move to the ice separation position as illustrated in (c) of FIG. 16.

As described above, when the second tray 380 moves to the ice separation position, ice may be separated from the second tray 380. After the ice is separated from the second tray 380, the controller 800 controls the driver 480 to allow the second tray 380 to move in the reverse direction (S14). Then, the second tray 380 moves from the ice separation position to the water supply position (S1).

When the second tray 380 moves to the water supply position, the controller 800 stops the driver 480. When the second tray 380 is spaced apart from the extension part 544 while the second tray 380 moves in the reverse direction, the deformed second tray 380 may be restored to its original shape. In the reverse movement of the second tray 380, the moving force of the second tray 380 is transmitted to the first pusher 260 by the pusher link 500, and thus, the first pusher 260 ascends, and the extension part 264 is removed from the ice making cell 320*a*.

As a result of the determination in operation S12, if it is determined that the ice bin 600 is full, the controller 800 controls the driver 480 so that the second tray 380 moves to the ice separation position for separating ice (S15).

That is, in this embodiment, even if the full ice is initially detected by the full ice detection part, the ice is separated from the second tray 380.

Then, the controller 800 controls the driver 480 so that the second tray 380 moves in the reverse direction to move to the water supply position (S16).

The controller 800 may determine whether a set time elapses while the second tray 380 moves to the water supply position (S17).

When the set time elapses in the state in which the second tray 380 moves to the water supply position, whether the ice bin is full may be detected again (S19).

For example, the controller 800 controls the driver 480 so that the second tray 380 moves from the water supply position to the full ice detection position.

That is, in this embodiment, after the second tray 380 moves to the ice separation position for separating ice, the detection of the full ice may be repetitively performed at a predetermined period.

As a result of determination in operation S19, when the full ice is detected, the second tray 380 moves to the water supply position to stand by.

On the other hand, as a result of the determination in operation S19, if the full ice is not detected, the second tray 380 may move from the full ice detection position to the ice separation position and then to the water supply position. Alternatively, the second tray 380 may moves in the reverse direction from the full ice position and then move to the water supply position.

In this embodiment, even when the full ice is detected, the reason for the ice separation is as follows.

If, after completion of the ice making, the full ice is detected to stand by in a state in which ice exists in the ice making cell 320*a*, the ice in the ice making cell 320*a* may be melted due to an abnormal situation such as power outage, cut-off of the power supply, and the like.

In this state, when the abnormal situation is released, the water melted in the ice making cell 320*a* may be changed to ice again.

However, since the full ice has already been detected, the transparent ice heater does not operate and stands by at the water supply position. Thus, the ice generated in the ice making cell 320*a* is not transparent.

When opaque ice is separated because the full ice is not detected later, the user uses the opaque ice, which may cause emotional dissatisfaction of the user.

If, after completion of the ice making, the full ice is detected to stand by in a state in which ice exists in the ice making cell 320*a*, the ice in the ice making cell 320*a* may be melted due to an abnormal situation such as opening of the door for a long time, proceeding of a defrosting operation, and the like.

As described above, in the state in which the second tray stands by at the water supply position, the full ice is detected again after a set time. Here, if melted water exists in the ice making cell 320*a*, the water may drop into the ice bin 600 in the movement process of the second tray 380. In this case, a problem occurs in that ice stored in the ice bin 600 sticks to each other by the dropping water.

However, as in this embodiment, when ice does not exist in the ice making cell in the standby process after the full ice detection, the above problem may be fundamentally controlled.

On the other hand, in the case of this embodiment, when the second tray 380 stands by at the water supply position when detecting the full ice, the second tray 380 may be prevented from sticking to the first tray 320, and thus, when the full ice is detected later, the second tray 380 may move smoothly.

In another aspect, the present invention may include an embodiment, in which the controller 800 controls the transparent ice heater 430 to be turned again on after the abnormal situation is terminated so as to reduce deterioration in transparency of the ice in the process, in which an external thermal load is introduced into the ice making cell 320*a* in the abnormal situation, and thus, the ice within the ice making cell 320*a* is repetitively melted and re-frozen.

When all of the ices are melted due to the abnormal situation, after the abnormal situation is terminated, one or more of the cooling power of the cold air supply part 900 and the heating amount of the heater may be controlled to vary in the same manner in which the ice making process performed by the controller 800 before the ice is melted.

However, when only a portion of the ice is melted due to the abnormal situation, after the abnormal situation is terminated, the cooling power of the cold air supply part 900 may be reduced, or the heating amount of the heater is reduced when compared to the ice making process performed by the controller 800 before the ice is melted.

Here, it is not easy to control the cooling power of the cold air supply part 900 and the heating amount of the heater so that the ice transparency before being re-frozen and the ice transparency after being re-frozen are matched.

This is done because, when ice is melted, the ice is gradually melted from the outside to the inside thereof, whereas since the transparent ice heater 430 locally heats one side of the ice making cell 320*a* so that bubbles dissolved in the water inside the ice making cell 320*a* move from the portion at which the ice is generated toward the water that is in the liquid state to induce the generation of the transparent ice, it is difficult to maintain the ice making rate when the ice is re-frozen at the same rate as before being re-frozen.

Particularly, among the embodiments of the present invention, in case of an embodiment, in which the controller 800 controls one or more of the cooling power of the cold air supply part 900 and the heating amount of the heater to vary according to a mass per unit height of water in the ice making cell 320*a*, it may be difficult to supply the cooling power and the heating amount when the ice is re-frozen in the same or similar manner as being re-frozen, and thus, the re-frozen ice may have transparency different from that of the existing frozen ice.

When the full ice of the ice bin 600 is detected by the full ice detection part 950, it may be designed so that a state, in which 100% of ice is not filled in the ice bin 600 is detected as the full ice so as to allow the controller 800 to control the driver so that the second tray 380 moves to the ice separation position after the ice making is completed.

This is because it is necessary to perform an additional one-time ice separation process after the full ice is detected. Thus, the present invention is characterized in that the controller 800 detects that the ice bin 600 is full when the total volume of separated ice inside the ice bin 600 reaches a reference value set within a range less than the total volume of the ice bin 600.

When the total volume of separated ice (i.e., volume of ice making cell ×number of times of separation of ice) reaches a full ice reference value (a range between the minimum and maximum values of the full ice reference value) set within a specific range, the controller 800 detects the state as the full ice. The full ice reference value may be set as follows.

60% of total volume of ice bin≤the full ice reference value≤total volume of ice bin−volume of ice making cell In an example in which an optical sensor is used for detecting the full ice, an optical sensor may be disposed so that a height of a parallel line connecting a light emitting part and a light receiving part of the optical sensor is greater than a height corresponding to 60% of the total volume of the ice bin and is equal or less than the maximum value of the full ice reference value.

In an example of using a rotation-type lever for detecting the full ice, the lever may be disposed so that a height of the lowest position of the lever is greater than a height corresponding to 60% of the total volume of the ice bin and is equal or less than the maximum value of the full ice reference value, based on a rotation path along which the rotation-type lever moves.

In an example of using a linearly movable lever for detecting the full ice, the lever may be disposed so that a height of the lowest position of the lever is greater than a height corresponding to 60% of the total volume of the ice bin and is equal to less than the maximum value of the full ice reference value, based on a linear path along which the linear lever moves.

Since the rotation arm 460 is connected to the cam 4830, the rotation angle of the cam 4830 in the process of moving from the ice making position to the ice separation position or the process of moving from the ice separation position to the ice making position may be the same as that of the second tray assembly.

However, in a state in which the rotation arm 460 is coupled to the second tray supporter 400, the rotation arm 460 and the second tray supporter 400 may rotate relative to each other within a predetermined angle range. For example, the through-hole 400 of the second tray supporter 400 may include a circular first portion and a pair of second portions extending symmetrically from the first portion.

The rotation arm 460 may include a protrusion disposed in the through-hole 400 in a state of being coupled to the shaft 440. The protrusion may include a cylindrical first protrusion. The first protrusion may be coupled to the first portion of the through-hole 404. The shaft 440 may be coupled to the first protrusion.

The coupling part may include a plurality or pair of second protrusions protruding in a radial direction of the first protrusion. The second protrusion may be disposed in the second portion of the through-hole.

A length of the second portion in a circumferential direction based on a rotation center of the shaft 440 may be greater than that of the second protrusion so that the second tray supporter 400 and the rotation arm 460 relatively rotate with respect to each other in the predetermined angle range.

Thus, in the state in which the second protrusion 464 is disposed at the second portion, the second tray supporter 400 and the rotation arm 460 may relatively rotate with respect to each other in a range of a difference between the length of the second protrusion 464 in the circumferential direction and the length of the second portion in the circumferential direction.

Due to this structure, in the state in which the second tray assembly moves to the ice making position, the cam 4830 may additionally rotate while the second tray assembly is stopped.

Referring to FIG. 17, the ice making position may be a position at which at least a portion of the ice making cell formed by the second tray 380 reaches a reference line passing through the rotation center (rotation center of the driver) of the shaft 440. Referring to FIG. 17, the water supply position may be a position before at least a portion of the ice making cell formed by the second tray 380 reaches the reference line passing through the rotation center C4 of the shaft 440.

It is assumed that the rotation angle of the cam 4830 is 0 at the ice making position. The cam 4830 may additionally rotate in the reverse direction due to the difference in length between the second protrusion of the rotation arm 460 and the second portion of the extension hole 404. That is, at the ice making position of the second tray assembly, the cam 4830 may additionally rotate in the reverse direction.

At the ice making position, the rotation angle of the cam 4830 when the cam 4830 rotates in the reverse direction may be referred to as a negative (−) rotation angle.

At the ice making position, the rotation angle of the cam 4830 when the cam 4830 rotates in the forward direction toward the water supply position or the ice separation position may be referred to as a positive (+) rotation angle. Hereinafter, in the case of the positive (+) rotation angle, the positive (+) value will be omitted.

At the ice making position, the cam 4830 may rotate to the water supply position at a first rotation angle. The first rotation angle may be greater than 0 degrees and less than 20 degrees. Preferably, the first rotation angle may be greater than 5 degrees and less than 15 degrees.

Since the water dropping into the second tray 380 is evenly spread into the plurality of ice making cell 320*a* by the setting of the water supply position according to the present invention, the overflowing of the water dropping into the second tray 380 may be prevented.

At the ice making position, the cam 4830 may rotate to the ice making position at a second rotation angle. A rotation angle of the second may be greater than 90 degrees and less than 180 degrees. Preferably, the second rotation angle may be greater than 90 degrees and less than 150 degrees. More preferably, the second rotation angle may be greater than 90 degrees and less than 150 degrees.

When the second rotation angle is greater than 90 degrees, ice may be easily separated from the second tray 380 while the second tray 380 is pressed by the second pusher 540. As a result, the separated ice may smoothly drop down without being caught on the end of the second tray 380.

At the ice separation position, the cam 4830 may additionally rotate at a third angle. The cam 4830 may additionally rotate in the forward direction at the third rotation angle in the state in which the second tray assembly moves to the ice separation position by an assembly tolerance of the cam 4830 and the rotation arm 460, a difference in rotation angle of the pair of rotation arms due to the cam 4830 being coupled to one of the pair of rotation arms 460, and the like. When the cam 4830 further rotates in the forward direction, pressing force applied by the second pusher 540 to press the second tray 380 may increase.

At the ice separation position, the cam 4830 may rotate in the reverse direction, and after the second tray assembly moves to the water supply position, the cam 4830 may further rotate in the reverse direction. The reverse direction may be a direction opposite to the direction of gravity. In consideration of the inertia of the tray assembly and the motor, if the cam further rotates in the direction opposite to the direction of gravity, it is advantageous in controlling the water supply position.

At the ice making position, the cam 4830 may rotate at a fourth rotation angle in the reverse direction. The fourth rotation angle may be set in a range of 0 degrees and negative (−) 30 degrees. Preferably, the fourth rotation angle may be set in a range of negative (−) 5 degrees and negative (−) 25 degrees. More preferably, the fourth rotation angle may be set in a range of negative (−) 10 degrees and negative (−) 20 degrees.

The invention claimed is:

1. A refrigerator comprising:

a storage chamber;

a cold air supply configured to supply cold air to the storage chamber; and an ice maker comprising:

a first tray having a first portion of a cell;

a second tray having a second portion of the cell, the first portion and the second portion being configured to define a space formed by the cell;

a driver that moves the second tray, relative to the first tray, such that the second portion of the second tray contacts the first portion of the first tray to form the space of the cell in an ice making process when a liquid in the space is phase-changed into ice, and that moves the second tray relative to the first tray such that the second portion of the second tray is to be spaced from the first portion of the first tray during an ice separation process to separate the ice from the cell;

an ice bin configured to store the ice when separated from the cell;

a detector configured to detect whether the ice bin is full; and a controller configured to—operate the driver so that:

the second tray moves to an ice making position after the liquid is supplied to the cell to allow the cold air supply part to supply the cold air to cell;

the second tray moves from the ice making position to an ice separation position to take remove the ice from the cell after the ice is formed;

the second tray moves to a liquid supply position to receive liquid in the space after the ice is removed from the cell; and when the detector determines that the ice bin is full after the ice is formed and before the ice is removed from the cell, the second tray continues to move to the ice separation position, wherein the controller controls the driver so that, when the detector detects that the ice bin is full, the second tray moves to the liquid supply position from the ice separation position, and remains at the liquid supply position for a set length of time, wherein, after the second tray remains at the liquid supply position for the set length of time, the detector determines whether ice bin is still full, and wherein:

when the detector detects the ice bin is still Bill, the controller controls the second tray to stand by at the liquid supply position without the liquid being supplied to the space, and when the detector detects that the ice bin is not full, the controller controls the liquid to be supplied to the space while the second tray is at the liquid supply position.

2. The refrigerator of claim 1, wherein the detector detects whether the ice bin is full while the second tray moves from the ice making position to the ice separation position.

3. The refrigerator of claim 2, wherein, after the detector detects that the ice bin is full and the second tray moves to the ice separation position, the detector rechecks whether the ice bin is full at a predetermined interval.

4. The refrigerator of claim 1, wherein the detector includes a lever that rotates based on receiving a force from the driver, and a rotation axis of the lever is parallel to a rotation axis of the second tray.

5. The refrigerator of claim 4, wherein the lever includes a first body extending in a direction parallel to the rotation axis of the second tray and a pair of second bodies extending from respective ends of the first body, and wherein at least one of the pair of second bodies is connected to the driver.

6. The refrigerator of claim 5, wherein, while the lever rotates, the first body is positioned lower than the second tray.

7. The refrigerator of claim 5, wherein the lever rotates to a detection position, when lever rotates to the detection position, the first body is inserted into the ice bin, and when the lever is at the detection position, a maximum distance between an upper end of the ice bin and the first body is less than a radius of the ice generated in the cell.

8. The refrigerator of claim 1, further comprising:

a heater provided adjacent to at least one of the first tray or the second tray, wherein the controller controls the heater to be turned on while the cold air supply supplies the cold air so that gas bubbles dissolved in the liquid move from a first portion of the space where the liquid has phase-changed into ice toward a second portion of the space where the liquid that is in a fluid state.

9. The refrigerator of claim 8, wherein the controller causes at least one of the cold air supplied by the cold air supply or an amount of heat provided by the heater to vary according to mass per unit height values of the liquid within respective sections of the space.

10. The refrigerator of claim 9, wherein the controller controls the heater to output a first amount of heat when the ice is forming in a first section of the space has a first mass per unit height value and to output a second amount of heat that is greater than the first amount of heat when the ice is forming in a second section of the space have a second mass per unit height value that is less than the first mass per unit height value while a cooling power of the cold air supply is maintained at a consistent level.

11. The refrigerator of claim 9, wherein the controller controls the cold air supply to provide a first amount of cooling power when the ice is forming in a first section of the space has a first the mass per unit height value and to provide a second amount of cooling power that is greater than the first amount of cooling power when the ice is forming in a second section of the space have a second mass per unit height value that is less than the first mass per unit height value while a heating amount of the heater is maintained at a consistent level.

12. The refrigerator of claim 1, wherein, when a total volume of the ice in the ice bin reaches a set value, the ice bin is determined to be full.

13. The refrigerator of claim 12, wherein the total volume of the ice in the bin corresponds to a volume of the cell multiplied by a number of ice bodies separated from the cell, and the full value is greater than 60% of a total volume of the ice bin and is equal to or less than a net volume obtained by subtracting the volume of the space of the cell from the total volume of the ice bin.

* * * * *